US012478839B2

(12) United States Patent
Hogge et al.

(10) Patent No.: US 12,478,839 B2
(45) Date of Patent: Nov. 25, 2025

(54) GOLF BALL HAVING AT LEAST ONE RADAR DETECTABLE MARK

(71) Applicant: Acushnet Company, Fairhaven, MA (US)

(72) Inventors: Matthew F. Hogge, Plymouth, MA (US); Nicholas M. Nardacci, Barrington, RI (US); Michael R. Madson, Easton, MA (US); Jedediah H. James, Dighton, MA (US)

(73) Assignee: Acushnet Company, Fairhaven, MA (US)

( * ) Notice: Subject to any disclaimer, the term of this patent is extended or adjusted under 35 U.S.C. 154(b) by 144 days.

(21) Appl. No.: 18/191,205

(22) Filed: Mar. 28, 2023

(65) Prior Publication Data

US 2023/0249034 A1 Aug. 10, 2023

Related U.S. Application Data

(63) Continuation-in-part of application No. 18/072,801, filed on Dec. 1, 2022, which is a continuation-in-part of application No. 17/553,122, filed on Dec. 16, 2021, which is a continuation-in-part of application No. 17/552,380, filed on Dec. 16, 2021, which is a continuation-in-part of application No. 17/515,971, filed on Nov. 1, 2021.

(60) Provisional application No. 63/212,225, filed on Jun. 18, 2021, provisional application No. 63/116,535, filed on Nov. 20, 2020, provisional application No. 63/116,803, filed on Nov. 20, 2020.

(51) Int. Cl.

| | |
|---|---|
| ***A63B 37/12*** | (2006.01) |
| ***A63B 37/00*** | (2006.01) |
| *A63B 24/00* | (2006.01) |
| *A63B 43/00* | (2006.01) |

(52) U.S. Cl.

CPC .. *A63B 37/00221* (2020.08); *A63B 37/00222* (2020.08); *A63B 2024/0034* (2013.01); *A63B 43/004* (2013.01); *A63B 2220/89* (2013.01)

(58) Field of Classification Search

CPC ..... A63B 69/3658; A63B 37/0022; A63B 37/0003; A63B 37/14; A63B 2024/0034

See application file for complete search history.

(56) References Cited

U.S. PATENT DOCUMENTS

| | | | |
|---|---|---|---|
| 4,284,276 | A | 8/1981 | Worst |
| 4,660,039 | A | 4/1987 | Barricks |
| 5,564,707 | A | 10/1996 | Dinh |

(Continued)

FOREIGN PATENT DOCUMENTS

| | | | |
|---|---|---|---|
| CN | 104083855 | A | 10/2014 |
| JP | 2020-081349 | A | 6/2020 |

*Primary Examiner* — Raeann Gorden

(74) *Attorney, Agent, or Firm* — Thomas P. Gushue

(57) ABSTRACT

A golf ball is disclosed herein that includes at least one radar detectable mark such that a projected pattern is formed when the at least one radar detectable mark is radially projected onto an outer surface of the golf ball. The projected pattern can have a first wave profile mapped along a path defined by a first spherical arc on the outer surface of the golf ball. The projected pattern can comprise at least one first crest and at least one first trough. The projected pattern can have a periodic function selected from: a sine wave, a sawtooth wave, a triangle wave, or a square wave.

17 Claims, 25 Drawing Sheets

(56) References Cited

U.S. PATENT DOCUMENTS

| | | | | |
|---|---|---|---|---|
| 6,217,463 | B1 | 4/2001 | Maruko | |
| 6,244,971 | B1 | 6/2001 | Mihran | |
| 6,422,949 | B1 | 7/2002 | Byrne | |
| 7,364,515 | B2 | 4/2008 | Kasashima | |
| 9,795,832 | B2 | 10/2017 | Saegusa | |
| 10,611,181 | B1 | 4/2020 | Moylan | |
| 10,918,915 | B1 | 2/2021 | Moylan | |
| 12,161,916 | B1 | 12/2024 | Simonds | |
| 2002/0086741 | A1 | 7/2002 | Newcomb | |
| 2003/0022724 | A1 | 1/2003 | Rennecamp | |
| 2003/0109319 | A1 | 6/2003 | Andresen | |
| 2005/0070375 | A1 | 3/2005 | Savarese | |
| 2006/0122007 | A1 | 6/2006 | Savarese | |
| 2007/0072700 | A1 | 3/2007 | Chute | |
| 2007/0105637 | A1 | 5/2007 | Shimizu | |
| 2007/0207874 | A1* | 9/2007 | Klein | A63B 69/3655 473/280 |
| 2008/0021651 | A1 | 1/2008 | Seeley | |
| 2008/0182090 | A1 | 7/2008 | Rouse | |
| 2010/0293777 | A1 | 11/2010 | Savarese | |
| 2011/0207553 | A1 | 8/2011 | Reid | |
| 2012/0058844 | A1* | 3/2012 | Huang | A63B 37/02 473/600 |
| 2013/0324310 | A1 | 12/2013 | Leech | |
| 2014/0018194 | A1 | 1/2014 | Wachi | |
| 2015/0020377 | A1 | 1/2015 | Savarese | |
| 2015/0087443 | A1 | 3/2015 | Saegusa | |
| 2018/0036603 | A1 | 2/2018 | Saegusa | |
| 2021/0008417 | A1* | 1/2021 | Tuxen | A63B 43/06 |
| 2022/0161101 | A1 | 5/2022 | Hogge | |
| 2022/0161102 | A1 | 5/2022 | Hogge | |
| 2022/0161103 | A1 | 5/2022 | Hogge | |
| 2022/0161104 | A1 | 5/2022 | Hogge | |
| 2022/0161118 | A1 | 5/2022 | Hogge | |
| 2023/0087352 | A1 | 3/2023 | Hogge | |
| 2023/0095376 | A1 | 3/2023 | Hogge | |

* cited by examiner

GOLF BALL HAVING AT LEAST ONE RADAR DETECTABLE MARK

CROSS-REFERENCE TO RELATED APPLICATIONS

The present application is a continuation in part of U.S. patent application Ser. No. 18/072,801, filed Dec. 1, 2022, which is a continuation-in-part of U.S. patent application Ser. No. 17/553,122, filed Dec. 16, 2021, which is a continuation-in-part of U.S. patent application Ser. No. 17/552,380, filed Dec. 16, 2021, which is a continuation-in-part of U.S. patent application Ser. No. 17/515,971, filed Nov. 1, 2021, which claims the benefit of U.S. Provisional Patent Application No. 63/116,535, filed Nov. 20, 2020, U.S. Provisional Patent Application No. 63/116,803, filed Nov. 20, 2020, and U.S. Provisional Patent Application No. 63/212,225, filed Jun. 18, 2021, the entire disclosures of which are each hereby incorporated herein by reference.

FIELD OF THE INVENTION

The present invention relates generally to golf balls including a mark, or a plurality of marks, for improving the detection and tracking thereof by radar tracking systems.

BACKGROUND OF THE INVENTION

Interest continues to increase in golf experiences which require a system for detecting golf ball launch conditions, such as golf simulators and golf equipment fitting. Radar tracking systems that are currently used for this purpose are limited, however, in their ability to accurately obtain launch condition data, for example, ball spin properties.

There are also disadvantages to the use of the radar reflective stickers that are commonly used with radar tracking systems. Radar reflective stickers are typically placed on the outer surface of the golf ball in order for radar tracking systems to obtain launch condition data. However, there are challenges associated with the use of these stickers, including, for example, accurate positioning of the stickers on the ball, alignment of the stickers relative to the golfer and tee, time and effort required to place the stickers on the ball, and lack of durability of the stickers, which further leads to a decrease in the quality of launch condition data and the need to replace the stickers.

Thus, there is a need for a golf ball that provides one or more of the following benefits: improved quality of golf ball launch condition data collected by radar tracking systems, and enhanced experience for the end users of these radar tracking systems.

SUMMARY OF THE INVENTION

The present disclosure is directed to a golf ball comprising at least one layer with a mark, or a plurality of marks, disposed on a surface thereof. In one aspect, a golf ball is disclosed that has at least one radar detectable mark such that a projected pattern is formed when the at least one radar detectable mark is radially projected onto an outer surface of the golf ball.

The projected pattern can comprise a first wave profile mapped along a path defined by a first spherical arc on the outer surface of the golf ball. The projected pattern comprises at least one first crest and at least one first trough. The first spherical arc can be defined along a first great circle on the outer surface of the golf ball.

The projected pattern can comprise a first terminal end and a second terminal end that are circumferentially spaced apart from each other to define a wave angular extent. The terminal ends can be spaced apart from each other by at least 45 degrees, in one example. The first terminal end and the second terminal end can be circumferentially spaced apart by 240 degrees-300 degrees, in one example. Stated differently, the wave angular extent can extend for at least 45 degrees, and preferably can extend for 240 degrees-300 degrees. The wave angular extent can extend for 270 degrees, in one example.

In one example including parallel waves, the circumferential spacing of the terminal ends of the wave profiles can vary in order to cover a predetermined wavelength or period. For example, two parallel wave profiles can have varying lengths to account for different positions relative to the printed surface and to align the wave angular extents of the two wave profiles.

The projected pattern can extend for at least 1.0 period in one example. In one example, the projected pattern can extend for less than 5.0 periods.

An amplitude of the first wave profile can have a relationship with the diameter of the golf ball. In one example, the amplitude is no greater than 40% of a diameter of the golf ball. In one example, the amplitude is no greater than 40% of a diameter of the golf ball cased core. In one example, the amplitude is no greater than 40% of a diameter of a golf ball sub-assembly. In other examples, the amplitude is 5%-50% of a diameter of the golf ball, the amplitude is 10%-30% of a diameter of the golf ball, or the amplitude is 15%-25% of a diameter of the golf ball. In other examples, the amplitude is 10%-60% of a diameter of the golf ball cased core, the amplitude is 20%-50% of a diameter of the golf ball cased core, or the amplitude is 25%-40% of a diameter of the golf ball cased core. In other examples, the amplitude is 5%-55% of a diameter of a golf ball sub-assembly, the amplitude is 15%-45% of a diameter of a golf ball sub-assembly, or the amplitude is 25%-40% of a diameter of a golf ball sub-assembly. The amplitude can be measured to a mid-point, center, or middle portion of the marking or projected pattern. In another example, the amplitude can be defined as at any two corresponding points on the spherical arc which are equidistant from the central axis of the wave profile.

The first wave profile can be formed according to a variety of wave profiles. For example, the wave profile can be one of: a sine wave, a sawtooth wave, a triangular wave, or a square wave. In one example, multiple wave forms can be combined.

The at least one radar detectable mark can be disposed on a single layer in one example. In another example, the at least one radar detectable mark can be comprised of a plurality of radar detectable marks that are disposed among more than one layer.

The projected pattern can be formed as a continuous, uninterrupted strip, in one example. In another example, the projected pattern can be formed as a plurality of discrete strips that are spaced apart from each other and aligned with each other such that the discrete strips define a wave profile in the aggregate. According to one aspect, the discrete strips are centered about a common through line or track such that the overall wave profile is defined by the discrete strips.

Various parameters, sizes, profiles, shapes, etc., of the wave profile and the radar detectable mark can vary. In one example, the radar detectable mark can have a width of 1.0 mm-5.0 mm. In one example, the first wave profile can have an amplitude of 7.0 mm-15.0 mm.

The projected pattern can further comprise a second wave profile with at least one second crest and at least one second trough. The first wave profile can be comprised of a plurality of first points and the second wave profile can be comprised of a plurality of second points. Each first point along the first wave profile and each closest adjacent second point along the second wave profile can be equidistant from each other such that a uniform normal distance is defined along an entirety of the first wave profile and the second wave profile. The uniform normal distance can be 4.0 mm-6.0 mm. The first and second wave profiles can be parallel to each other. In another aspect, a normal distance between the wave profiles can vary and can be non-uniform.

The first wave profile and the second wave profile can each have a predetermined amplitude that is identical to each other, such that the uniform normal distance is at least half of the predetermined amplitude, and the uniform normal distance is no greater than twice the predetermined amplitude.

The second wave profile can be mapped along a path defined by a second spherical arc that is positioned away from the first spherical arc.

Another example of a golf ball is disclosed herein. The golf ball can have at least one radar detectable mark such that a projected pattern is formed when the at least one radar detectable mark is radially projected onto an outer surface of the golf ball. The projected pattern can comprise a first wave profile defined by a periodic function and mapped along a path defined by a first spherical arc on the outer surface of the golf ball. The periodic function can be selected from one of: a sine wave, a sawtooth wave, a triangle wave, or a square wave. In other examples, the wave profile can be defined as a combination of wave forms to produce another periodic function. Any one or more of a sine wave, a sawtooth wave, a triangle wave, or a square wave can be combined, in addition to any other function or periodic profile.

The projected pattern can have a wave angular extent of 45 degrees-270 degrees, in one example. The periodic function can repeat for at least 1.0 period. The projected pattern can further include a second wave profile with at least one second crest and at least one second trough. A uniform normal distance can be defined along an entirety of the first wave profile and the second wave profile. The first wave profile can have a first amplitude, and the second wave profile can have a second amplitude. The uniform normal distance can be less than half of the first amplitude. The uniform normal distance can be less than half of the second amplitude. The first amplitude can be no greater than 40% of a diameter of at least one of: the golf ball, a cased core of the golf ball, or a sub-assembly of the golf ball.

Another example of a golf ball is also disclosed herein. The golf ball can have at least one radar detectable mark such that a projected pattern is formed when the at least one radar detectable mark is radially projected onto an outer surface of the golf ball. The projected pattern can comprise a first wave profile defined by a periodic function and mapped along a path defined by a first spherical arc on the outer surface of the golf ball. The periodic function can be a sine wave, and the periodic function can repeat for at least 1.0 period.

Additional aspects and features of forming a golf ball having a projected pattern and radar detectable mark are disclosed herein.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
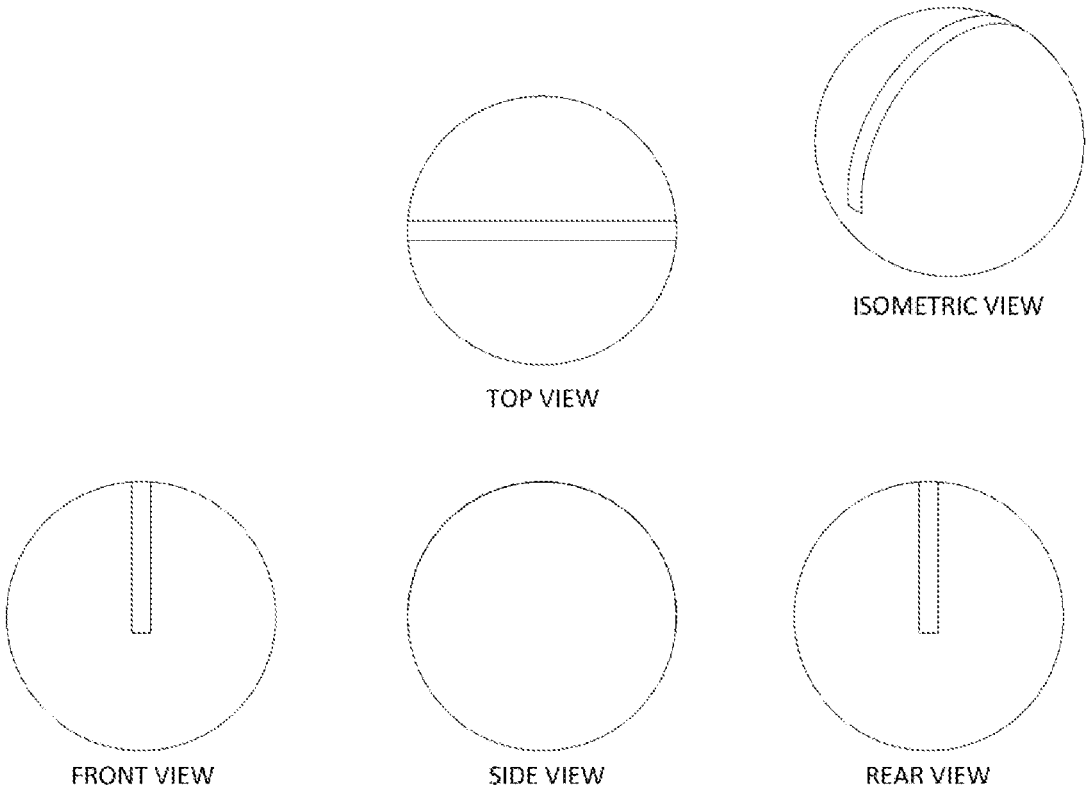
FIG. 1 illustrates a top view, an isometric view, a front view, a side view, and a rear view of a mark, according to an embodiment of the present invention.

Golf balls of the present invention include one or more layers which have at least one radar detectable mark disposed on a surface thereof. Particularly suitable radar detectable materials for forming the mark include, but are not limited to, electrically conductive inks comprising a base resin and an electrically conductive material. The ink may be water-borne or solvent-borne. The ink may be a 1-component or 2-component ink. The ink may be cured with an isocyanate-based curing agent, UV cure, and/or thermal cure. The ink and the mark formed therefrom may be transparent or opaque. In a particular embodiment, the base resin of the ink is selected from the group consisting of vinyl polymers, urethane polymers, acrylic polymers, epoxy polymers, and combinations of two or more thereof. In another particular embodiment, the electrically conductive material of the ink is selected from the group consisting of silver, conductive carbon, aluminum, graphene, nanotubes, nanometals, and combinations of two or more thereof. Particularly suitable inks are those capable of producing a mark having a resistivity of 0.1 Ohms or 0.5 Ohms or 1 Ohm or 5 Ohms or 6 Ohms or 7 Ohms or 25 Ohms or 2,500 Ohms, or a resistivity within a range having a lower limit and an upper limit selected from these values. Non-limiting examples of suitable commercially available inks are Ink Lab 303 silver conductive ink, commercially available from ITW Trans Tech; silver inks, conductive carbon inks, aluminum inks, silver/carbon blend inks, and aluminum/carbon blend inks, commercially available from Creative Materials Inc. In embodiments of the present invention wherein the golf ball includes more than one radar detectable mark on a single layer, the radar detectable material used to form one mark may be the same as or different from the radar detectable material used to form another mark. In embodiments of the present invention wherein the golf ball includes at least two layers having one or more radar detectable marks disposed on a surface thereof, the radar detectable material used to form a mark on one layer may be the same as or different from the radar detectable material used to form a mark on another layer.

Radar detectable material is applied to the surface of a layer using any suitable technique. In a particular embodiment, a mark is formed by applying radar detectable material to a surface of a golf ball layer by pad printing. In a particular aspect of this embodiment, the pad printed mark has a film thickness of at least 0.5 μm, or a film thickness of 5 μm or less, or a film thickness within a range having a lower limit and an upper limit selected from 0.5 μm, 1 μm, 3 μm, 4 μm, and 5 μm.

The surface on which one or more radar detectable marks are disposed can be any surface of any layer of a golf ball having any number of layers. While the invention is not meant to be limited to the placement of one or more marks on the surface of a particular layer, golf balls of the present invention are designed to allow for the optional placement of radar detectable marks on a surface other than the outer surface of the ball because it is beneficial to some golfers to be able to obtain reliable launch condition data using a golf ball that looks the same on the outside as a conventional golf ball. Thus, in a particular embodiment, one or more radar detectable marks are disposed on any surface of any layer of the golf ball other than the outermost surface.

In another particular embodiment, the golf ball is a solid, one-piece golf ball, and one or more radar detectable marks are disposed on the outer surface of the ball.

In another particular embodiment, the golf ball is a two-piece golf ball consisting of an inner core layer and an outer cover layer, and one or more radar detectable marks are disposed on:

a) the outer surface of the outer cover layer, and/or
b) the inner surface of the outer cover layer, and/or
c) the outer surface of the inner core layer.

In another particular embodiment, the golf ball is a three-piece golf ball consisting of an inner core layer, an outer cover layer, and an intermediate layer disposed between the inner core layer and the outer cover layer, and one or more radar detectable marks are disposed on:

a) the outer surface of the outer cover layer, and/or
b) the inner surface of the outer cover layer, and/or
c) the outer surface of the inner core layer, and/or
d) the outer surface of the intermediate layer, and/or
e) the inner surface of the intermediate layer.

In another particular embodiment, the golf ball is a four-piece golf ball consisting of an inner core layer, a first intermediate layer, a second intermediate layer, and an outer cover layer, and one or more radar detectable marks are disposed on:

a) the outer surface of the outer cover layer, and/or
b) the inner surface of the outer cover layer, and/or
c) the outer surface of the inner core layer, and/or
d) the outer surface of the first intermediate layer, and/or
e) the inner surface of the first intermediate layer, and/or
f) the outer surface of the second intermediate layer, and/or
g) the inner surface of the second intermediate layer.

In another particular embodiment, the golf ball is a five- or more piece golf ball comprising an inner core layer, a first intermediate layer, a second intermediate layer, a third intermediate layer, optional additional intermediate layers, and an outer cover layer, and one or more radar detectable marks are disposed on:

a) the outer surface of the outer cover layer, and/or
b) the inner surface of the outer cover layer, and/or
c) the outer surface of the inner core layer, and/or
d) the outer surface of the first intermediate layer, and/or
e) the inner surface of the first intermediate layer, and/or
f) the outer surface of the second intermediate layer, and/or
g) the inner surface of the second intermediate layer, and/or
h) the outer surface of the third intermediate layer, and/or
i) the inner surface of the third intermediate layer, and/or
j) the inner or outer surface of an optional additional intermediate layer.

For purposes of the present disclosure, the number of pieces/layers of a golf ball does not include any optional coatings, such as paint coatings, finish coatings, adhesive coatings, etc., even if the coating covers an entire surface of a golf ball layer. Such coatings have a thickness that is substantially less than conventional golf ball layer thicknesses, and are generally not considered by those of ordinary skill in the art to be "golf ball layers" when reference is made to a one-piece/one-layer golf ball, two-piece/two-layer golf ball, three-piece/three-layer golf ball, and so on, despite sometimes being referred to as an adhesive layer, a paint layer, a top coat layer, etc. Thus, a two-piece golf ball consisting of an inner core layer and an outer cover layer, for example, may additionally include one or more coatings.

Also, for purposes of the present disclosure, a mark is considered to be disposed on the surface of a layer regardless of whether a coating has previously been applied to the surface. In other words, if an adhesive coating is applied to a surface of a layer, and a mark is then applied on top of the adhesive coating, the mark is considered to be disposed on the surface of the layer, even though an adhesive coating is present therebetween. Likewise, if a coating is present between two layers of the ball, the layers are still considered to be adjacent to each other, even though a coating may be present therebetween.

In a particular embodiment, golf balls of the invention include an adhesive coating applied to a layer on which at least one radar detectable mark is disposed, before and/or after application of the mark(s) onto the layer. In a particular aspect of this embodiment, at least one mark is disposed on a surface of a golf ball layer and an adhesive coating is applied to the layer and on top of the mark(s). In another particular aspect of this embodiment, an adhesive coating is applied to a surface of a golf ball layer and at least one mark is disposed on the layer on top of the adhesive coating. In another particular aspect of this embodiment, a first adhesive coating is applied to a surface of a golf ball layer, at least one mark is disposed on the layer on top of the adhesive coating, and a second adhesive coating is applied to the layer and on top of the mark(s).

Each radar detectable mark has a shape selected from a variety of suitable shapes, including regular shapes and irregular shapes. Suitable examples of regular shapes include, but are not limited to, circles, rings, crescents, squares, triangles, rectangles (also referred to herein as rectangular stripes), chevrons, and other regular polygons, irregular polygons, and basic nonpolygonal shapes. Suitable examples of irregular shapes include, but are not limited to, intersecting shapes, including, but not limited to, a series of intersecting stripes, other than chevrons (which are considered a regular shape despite consisting of two intersecting stripes), wherein the length and width of each stripe within the series of intersecting stripes may be different than or substantially the same as that of the other stripe(s) within the series. For purposes of the present disclosure, stripes have substantially the same length and/or width if their respective lengths and/or widths differ by no more than 10%. For purposes of the present disclosure, a "stripe" may be a rectangular stripe (i.e., wherein each of the four boundary lines defining the stripe is a straight line and wherein adjacent sides meet at right angles) or a non-rectangular stripe (i.e., wherein at least one of the four boundary lines defining the stripe is not a straight line or wherein adjacent sides meet at an angle other than a right angle, or both). Because the radar detectable marks are present on the surface of a spherical golf ball layer, it should be understood, for example, that the "straight line" boundary lines of a mark having the shape of a rectangular stripe are formed by drawing straight lines on a sphere, and, therefore, in a purely mathematical sense, are present on a golf ball layer as arcs. Additionally, for purpose of the present disclosure, stripes on a single layer are considered to intersect if they meet at one or more locations on the layer, regardless of whether or not one or more of the stripes continues past the point of intersection. Similarly, for purposes of the present disclosure, stripes that are disposed between two or more layers are considered to intersect if, when the stripes are radially projected onto the outer surface of the ball, they meet at one or more locations on the outer surface of the ball, regardless of whether or not one or more of the stripes continues past the point of intersection.

In a particular embodiment, the golf ball includes at least one radar detectable mark having an irregular shape defined by a series of intersecting rectangular stripes. In a particular aspect of this embodiment, the mark having an irregular shape additionally has one or more of the following properties:

a) the series of intersecting stripes consists of three rectangular stripes, or the series of intersecting stripes consists of four rectangular stripes, or the series of intersecting stripes comprises at least five rectangular stripes;

b) the series of intersecting stripes includes a first stripe and a second stripe, and the first and second stripes are substantially equal in length;

(i) a plane bisecting the first stripe and a plane bisecting the second stripe are separated by an angle of 60° or 85° or 95° or 120° or an angle within a range having a lower limit and an upper limit selected from these values;

(ii) the first and second stripes are substantially equal in width; and (iii) the first and second stripes have a length of 1.8 or 2.6 or 3.0 inches or a length within a range having a lower limit and an upper limit selected from these values; and (iv) the series of intersecting stripes additionally includes a third stripe and a fourth stripe, and a plane bisecting the third stripe and a plane bisecting the fourth stripe are separated by an angle of 60° or 85° or 95° or 120° or an angle within a range having a lower limit and an upper limit selected from these values;

c) each of the stripes within the series of intersecting stripes has a width of 0.20 inches or less, or a width of 0.03 inches or greater, or a width of from 0.03 inches to 0.20 inches, and, optionally, all of the stripes within the series have substantially the same width;

d) the series of intersecting stripes includes a first stripe, a second stripe, and a third stripe, each of the first and second stripes having a length of 1.8 or 2.6 or 3.0 inches or a length within a range having a lower limit and an upper limit selected from these values, and the third stripe having a length of from 0.12 inches to 0.50 inches; and e) the series of intersecting stripes includes a first stripe, a second stripe, a third stripe, and a fourth stripe, the fourth stripe having a length that is less than that of the first and second stripes and greater than that of the third stripe.

Figure 12A:
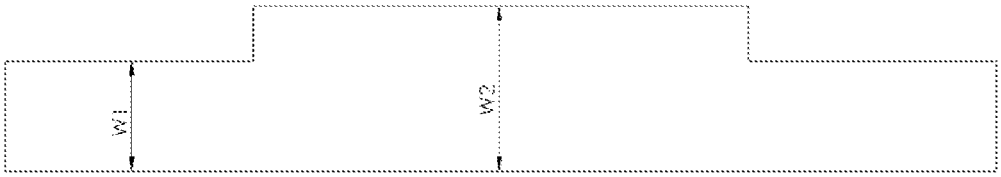
FIGS. 12A and 12B are schematic diagrams illustrating a method for determining the average width of an irregular shape according to an embodiment of the present invention.
Figure 12B:
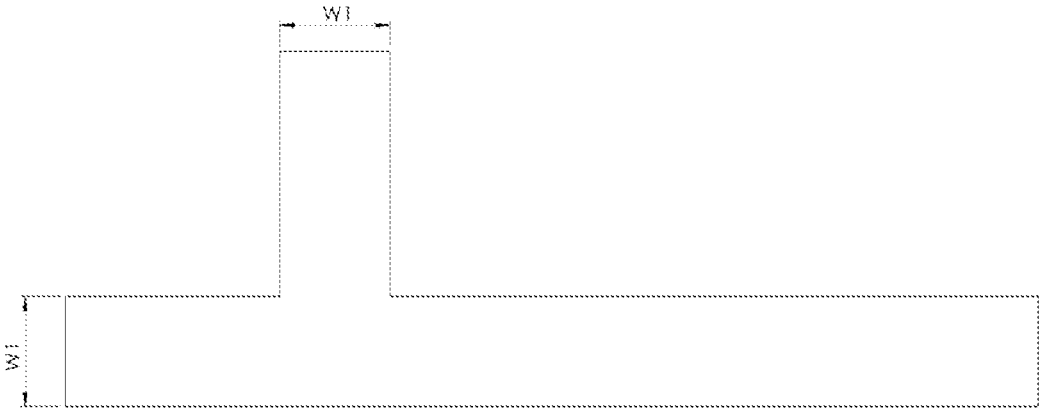

In another particular aspect of this embodiment, the golf ball includes at least one additional radar detectable mark, each of the additional radar detectable mark(s) having a shape independently selected from irregular shapes and basic, regular shapes. Suitable examples of basic, regular shapes include, but are not limited to, circles, rings, crescents, squares, triangles, rectangles, chevrons, and other regular polygons, irregular polygons, and basic nonpolygonal shapes. In a further particular aspect of this particular embodiment, the shape of at least one of the additional radar detectable mark(s) is a rectangular stripe, optionally having a length of from 0.15 inches to 0.75 inches, and optionally having a width that is substantially the same as the average width of the radar detectable mark having an irregular shape defined by a series of intersecting rectangular stripes. For purposes of the present disclosure, the average width of a mark having an irregular shape defined by a series of intersecting rectangular stripes is determined as follows. The average width is the average width across all portions of the mark. As would be readily understood by one of ordinary skill in the art, to the extent that the shape deviates from its typical shape, the "width" of that portion is determined relative to appropriate aspect ratio. For example, in FIG. 12A, the mark is wider at the middle 50% of the mark, so half of the mark has a width of W1 and half of the mark has a width of W2, so the average width is calculated as (W1+W2)/2. However, in FIG. 12B, the mark has a design such that a different dimension is used for measuring width, and since both distinct portions of the mark have a width of W1, the average width is also W1.

In another particular embodiment, the golf ball includes at least eleven radar detectable marks. In a particular aspect of this embodiment, each of the at least eleven radar detectable marks has a non-circular shape independently selected from rings, ellipses, polygons, squares, chevrons, crescents, and stripes. In another particular aspect of this embodiment, the radar detectable marks are equally spaced. In another particular aspect of this embodiment, the radar detectable marks additionally have one or more of the following properties:

a) the number of marks is a prime number, optionally selected from 11, 13, 17, 19, 23, 29, 31, and 37;

b) the marks consist of one or more marks having the shape of a stripe and one or more marks having the shape of a chevron, and, optionally, the difference in the number of marks having the shape of a stripe and the number of marks having the shape of a chevron is 1;

c) the marks have a total surface coverage of 5% or 10% or 15% or 20% or 25%, or a total surface coverage within a range having a lower limit and an upper limit selected from these values;

d) all of the radar detectable marks on the ball are disposed on a single layer of the golf ball; and e) the radar detectable marks are disposed among two or more layers of the golf ball.

In another particular aspect of this embodiment, the centroid of each of the radar detectable marks is positioned at a vertex of one of a plurality of spherical triangles created from a plurality of great circle arcs, wherein:

$$2V-4=T$$

$$3T/2=ET-E+V=2$$

$$3T/2=ET-E+V=2$$

where E is the total number of great circle arcs, T is the total number of spherical triangles, and V is the total number of vertices. The total surface area, A, of the spherical triangles is calculated as $4\pi r^2/T=A$. The position of the centroids of the radar detectable marks is determined with all of the marks present on the surface of any layer of the golf ball radially projected onto the outer surface of the ball.

For purposes of the present disclosure, marks on a layer are "equally spaced" if, when the distances between the centroid of each mark and the centroid of its adjacent marks is calculated, the maximum difference between any two of these distances is 0.040 inches or less. In embodiments of the present invention wherein the radar detectable marks are disposed among two or more layers of the golf ball, in order to determine if all of the radar detectable marks present on the ball are equally spaced, all of the radar detectable marks present on any layer of the ball are radially projected onto the outer surface of the ball.

In another particular embodiment, the golf ball includes a radar detectable mark having a continuous non-circular shape and a surface coverage of from 0.1% to 4.0%, or from 0.1% to 3.0%. The mark can be disposed on a single surface of a single layer of the ball; or, the mark can be disposed among two or more surfaces of the ball (i.e., the inner and outer surface of a single layer or any surface of two or more layers), such that, when all of the radar detectable marks present on any surface of any layer of the ball are radially projected onto the outer surface of the ball, the result is a projected mark having an overall continuous non-circular shape and a surface coverage of from 0.1% to 4.0%. In a particular aspect of this embodiment, the non-circular shape is independently selected from rings, ellipses, polygons, squares, crescents, stripes, two intersecting stripes (including chevrons and non-chevron shapes), and three or more intersecting stripes. In another particular aspect of this embodiment, the mark (or projected mark), is a continuous shape comprising two or more intersecting stripes, including a first stripe and a second stripe, and, optionally, has one or more of the following properties:

a) the first and second stripes are substantially equal in length;
b) the first and second stripes are substantially equal in width;
c) a plane bisecting the first stripe and a plane bisecting the second stripe are separated by an angle of 60° or 85° or 95° or 120° or an angle within a range having a lower limit and an upper limit selected from these values;
d) the first and second stripes each have a length of 1.0 inches or less, or a length of from 0.6 inches to 1.0 inches;
e) the first and second stripes each have a width of 0.20 inches or less, or a width of from 0.03 inches to 0.20 inches; and
f) the mark includes a third stripe, and the third stripe optionally has one or more of: a width of 0.20 inches or less, substantially the same width as the first stripe and the second stripe, a length of from 0.12 inches to 0.50 inches.

In another particular embodiment, the golf ball includes a plurality of radar detectable marks, and the total surface coverage of the radar detectable marks is from 0.1% to 4.0%, or from 0.1% to 3.0%. In a particular aspect of this embodiment, each of the radar detectable marks has a non-circular shape, and, optionally, each non-circular shape is independently selected from rings, ellipses, polygons, squares, crescents, chevrons, and stripes. In another particular aspect of this embodiment, the plurality of radar detectable marks comprises two or more non-intersecting stripes, including a first stripe and a second stripe, and, optionally, has one or more of the following properties:

a) the first and second stripes are substantially equal in length;
b) the first and second stripes are substantially equal in width;
c) a plane bisecting the first stripe and a plane bisecting the second stripe are separated by an angle of 60° or 85° or 95° or 120° or an angle within a range having a lower limit and an upper limit selected from these values;
d) the first and second stripes each have a length of 1.0 inches or less, or a length of from 0.6 inches to 1.0 inches;
e) the first and second stripes each have a width of 0.20 inches or less, or a width of from 0.03 inches to 0.20 inches; and
f) the mark includes a third stripe, and the third stripe optionally has one or more of: a width of 0.20 inches or less, substantially the same width as the first stripe and the second stripe, a length of from 0.12 inches to 0.50 inches.

In another particular embodiment, the golf ball includes a plurality of radar detectable marks wherein, when all of the radar detectable marks present on any layer of the ball are radially projected onto the outer surface of the ball, the resulting overall pattern of projected radar detectable marks includes at least one series of three or more radar detectable marks located on a 1.5 mm wide great circle band on the outer surface of the golf ball. For purposes of the present disclosure, a series of three or more radar detectable marks in the overall pattern of projected radar detectable marks, located on a 1.5 mm wide great circle band on the outer surface of the ball, is referred to herein as a "great circle series" of marks. For purposes of the present disclosure, the presence and number of great circle series within an overall pattern of projected radar detectable marks is determined as follows. First, as previously stated, all of the radar detectable marks present on any layer of the ball are radially projected onto the outer surface of the ball. The geometric center of each radially projected radar detectable mark is then determined using calculation methods well known to those of ordinary skill in the art. If the geometric centers of at least three radially projected radar detectable marks are located on the same 1.5 mm wide great circle band on the outer surface of the ball, then a great circle series is defined and each radially projected radar detectable mark having a geometric center located on that 1.5 mm wide great circle band is part of that great circle series. It should be noted that, so long as the geometric center of a given radially projected radar detectable mark is located on the 1.5 mm wide great circle band, the mark is part of that great circle series, regardless of whether any portion of the mark lies outside of the 1.5 mm wide great circle band defining that series. It should also be noted that, for purposes of the present disclosure, a single radar detectable mark can be part of more than one great circle series. In a particular aspect of this embodiment, the plurality of radar detectable marks additionally has one or more of the following properties:

a) the number of marks in the great circle series is four or more;
b) each pair of adjacent marks in the great circle series is separated by substantially the same distance (i.e., within 10%) as every other pair of adjacent marks in the great circle series, allowing for manufacturing tolerances, separation distance being calculated as the spherical length of the shortest great circle arc that can be drawn on the surface containing the marks (or, for embodiments wherein marks are present on more than one surface, the spherical length of the shortest great circle arc that can be drawn on the surface containing a radial projection of the marks), that connects any point on one mark in the pair of adjacent marks to any point on the other mark in the pair of adjacent marks;

c) the plurality of radar detectable marks consists essentially of one great circle series of marks;

d) the plurality of radar detectable marks includes at least one great circle series of marks and one or more additional radar detectable marks that are not part of a great circle series;

e) the plurality of radar detectable marks are positioned such that, when all of the radar detectable marks present on any layer of the ball are radially projected onto the outer surface of the ball, every great circle on the outer surface of the ball divides the ball into two hemispheres, each of the two hemispheres containing at least a portion of a radar detectable mark on the outer surface thereof; and f) the portion of the great circle band on which the marks of a given great circle series are located has a length of no more than half of the circumference of the ball, and, optionally, has a length of at least 40%, or at least 42%, or at least 45%, of the circumference of the ball.

For purposes of the present disclosure, unless otherwise noted, the length of the portion of the great circle band on which the marks of a given great circle series are located is calculated as the length of the smallest rectangular boundary (i.e., the arc length of the longest edge of the rectangular boundary) that can be drawn on the outer surface of the ball such that no portion of any mark of that great circle series lies outside of the boundary, as determined based on the radial projection of the marks onto the outer surface of the ball.

In another particular embodiment, the golf ball includes a plurality of radar detectable marks wherein, when all of the radar detectable marks present on any layer of the ball are radially projected onto the outer surface of the ball, the resulting overall pattern of projected radar detectable marks includes at least two great circle series of marks. In a particular aspect of this embodiment, each of the plurality of radar detectable marks is part of at least one great circle series. In another particular aspect of this embodiment, the plurality of radar detectable marks includes at least one mark that is not part of a great circle series. In another particular aspect of this embodiment, for at least one great circle series, the portion of the great circle band on which the marks of that great circle series are located has a length of no more than half of the circumference of the ball; optionally, the length is at least 40%, or at least 42%, or at least 45% of the circumference of the ball. In another particular aspect of this embodiment, for at least one great circle series, the portion of the great circle band on which the marks of that great circle series are located has a length of greater than half of the circumference of the ball. In another particular aspect of this embodiment, a plane bisecting one of the at least two great circle series and a plane bisecting another of the at least two great circle series are separated by an angle of 30° or 60° or 80° or 90° or an angle within a range having a lower limit and an upper limit selected from these values, as determined based on the radial projection of the marks onto the outer surface of the ball. In another particular aspect of this embodiment, when all of the radar detectable marks present on any layer of the ball are radially projected onto the outer surface of the ball, every great circle on the outer surface of the ball divides the ball into two hemispheres, each of the two hemispheres containing at least a portion of a radar detectable mark on the outer surface thereof. In another particular aspect of this embodiment, each great circle series of marks independently has one or more of the following additional properties:

a) the number of marks in the great circle series is from three to ten, or the number of marks in the great circle series is four or more, or the number of marks in the great circle series is from four to ten;

b) each of the marks in the great circle series has an actual length (i.e., as measured on the printed mark itself and not a radial projection of the mark) of 25 mm or less, or a length of 10 mm or less;

c) each of the marks in the great circle series has substantially the same projected length (i.e., their respective projected lengths differ by no more than 10%, based on a radial projection of the marks onto the outer surface of the ball);

d) each of the marks in the great circle series has an actual width (as measured on the printed mark itself and not a radial projection of the mark) of 3 mm or less, or a width of 2 mm or less;

e) each of the marks in the great circle series has substantially the same projected width (i.e., their respective widths differ by no more than 10%, based on a radial projection of the marks on the outer surface of the ball);

f) each pair of adjacent marks in the great circle series:

i) is separated by a distance of 0.5 mm or greater; and/or ii) is separated by a distance substantially equivalent to (i.e., within 10% of) the length of at least one of the marks in that great circle series; and/or iii) is separated by substantially the same distance (i.e., within 10%) as every other pair of adjacent marks in that great circle series, allowing for manufacturing tolerances, separation distance being calculated as the spherical length of the shortest great circle arc that can be drawn on the surface containing the marks (or, for embodiments wherein marks are present on more than one surface, the spherical length of the shortest great circle arc that can be drawn on the surface containing a radial projection of the marks), that connects any point on one mark in the pair of adjacent marks to any point on the other mark in the pair of adjacent marks; and g) the series has an angular length of 160° or 165° or 170° or 175° or 180° or 185°, or an angular length within a range having a lower limit and an upper limit selected from these values.

Figure 17:
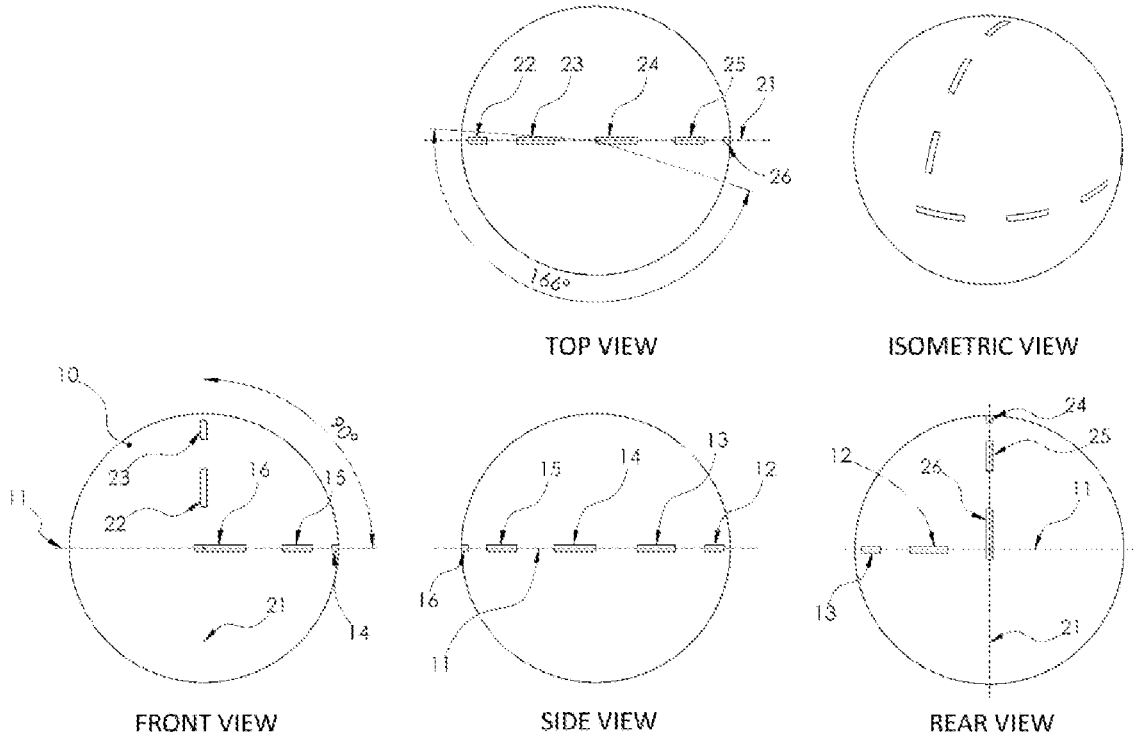
FIG. 17 illustrates a top view, an isometric view, a front view, a side view, and a rear view of a marking pattern, according to an embodiment of the present invention.

For purposes of the present disclosure, angular length of a great circle series of marks is determined as follows, based on a radial projection of the marks onto the outer surface of the ball. Using the geometric center of each of the projected marks within the great circle series, the bisecting plane of the series is determined. A first line and a last line are drawn, each line connecting the center of the ball to the point on the surface of the ball in the bisecting plane which results in the smallest angle between the first and last lines that can be drawn such that no portion of any mark of that great circle series lies outside of the angle. The "angular length of the great circle series" is the angle between the first and last lines. For example, FIG. 17 shows a great circle series consisting of marks 12, 13, 14, 15 and 16, wherein the great circle series has an angular length of about 166°.

In embodiments of the present invention wherein the golf ball includes more than one radar detectable mark on a single layer, the shape and/or size of one mark may be the same as or different from the shape and/or size of another mark. In embodiments of the present invention wherein the golf ball includes at least two layers having one or more radar detectable marks disposed on a surface thereof, the shape and/or size of a mark on one layer may be the same as or different from the shape and/or size of a mark on another layer. In embodiments of the present invention wherein the golf ball includes radar detectable marks that are part of a great circle series, the shape and/or size of one mark in the series may be the same as or different from the shape and/or size of another mark in the series. In a particular embodiment, the golf ball includes at least one radar detectable mark that has a non-circular shape disposed on a surface of a layer thereof. In a particular aspect of this embodiment, the non-circular shape is an irregular shape.

In one example, a golf ball is disclosed herein that comprises at least one layer with a mark, or a plurality of marks, disposed on a surface thereof. In one aspect, the golf ball has at least one radar detectable mark such that a projected pattern is formed when the at least one radar detectable mark is radially projected onto an outer surface of the golf ball. The mark(s) or marking(s) can be radially projected to form a pattern on a surface of the golf ball. The pattern can have an overall profile or shape. In one example, the projected pattern has a periodic profile. For example, the projected pattern can have at least one crest and at least one trough, and be centered or aligned relative to a path, such as a great circle or a spherical arc about the golf ball. The path can be defined as a great circle or a circular arc, in some examples. The path can be defined by a straight line or a plane, in some examples.

The projected pattern comprises a first wave profile mapped along a path defined by a first spherical arc on the outer surface of the golf ball. The phrase "mapped along a path" can mean that the projected pattern generally is generally oriented or centered relative to the path. In one example, a function defining the wave profile is generally disposed about the path, or defined relative to the path. In one example, a first half of the projected pattern is above the path, and a second half of the projected pattern is below the path. However, the distribution of the projected pattern above and below the path can vary. For example, the projected pattern can have a non-whole number of periods and therefore can start and stop in different positions along the wave profile thereby resulting in an unequal distribution of the projected pattern above or below the path.

The projected pattern comprises at least one first crest and at least one first trough. The first spherical arc can be defined along a first great circle on the outer surface of the golf ball. The term wave can refer to a periodic function or profile in one example. In another example, the term wave can refer to an aperiodic function or profile. FIGS. 19A-26E illustrate exemplary profiles having repeating profiles or wave-like profiles. In some examples, a single marking is provided on the outer surface of the golf ball, while in other examples, at least two markings are provided on the outer surface of the golf ball. In the examples with two markings, the two markings can be stacked on top of each other and have parallel alignment or orientations.

Figure 27:
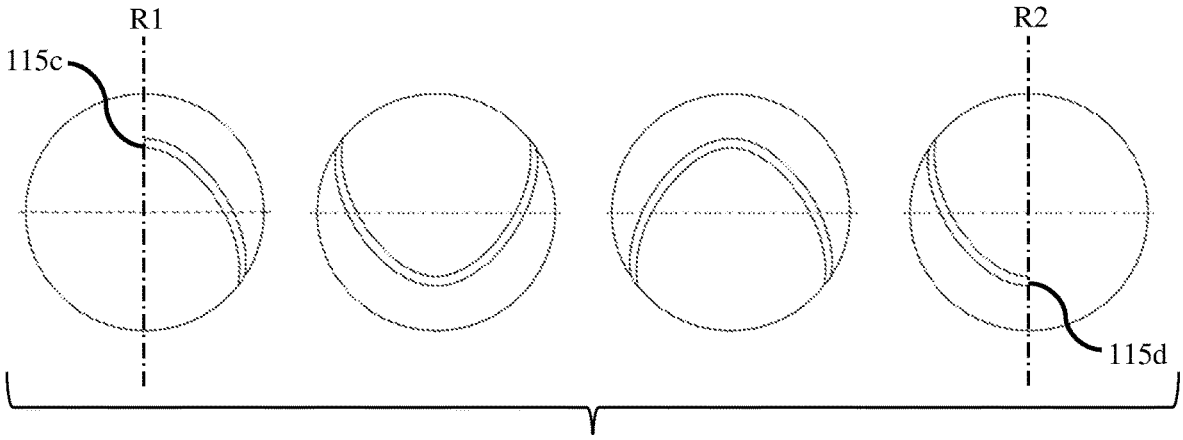
FIG. 27 illustrates the rear, first side, front, and second side views of the marking pattern from FIGS. 19A-19D with additional annotations.

The projected pattern can comprise a first terminal end and a second terminal end that are circumferentially spaced apart from each other to define a wave angular extent (which is further illustratively defined herein with respect to FIG. 27). The terminal ends can be spaced apart from each other by at least 45 degrees, in one example. The first terminal end and the second terminal end can be circumferentially spaced apart by 240 degrees-300 degrees, in one example. The first terminal end and the second terminal end can be circumferentially spaced apart by 270 degrees, in one example. The first terminal end and the second terminal end can be circumferentially spaced apart by 180 degrees, in one example. The first terminal end and the second terminal end can be circumferentially spaced apart by 330 degrees, in one example. In one example, the projected pattern can lack any terminal ends and can instead be continuous. The wave angular extent can be at least 45 degrees, preferably 240 degrees-300 degrees, and most preferably 270 degrees.

The projected pattern can extend for at least 1.0 period in one example. In one example, the projected pattern can extend for less than 5.0 periods. In one example, the projected pattern can extend for more than 5.0 periods. In one example, the projected pattern can extend for 0.5 period to 10.0 periods.

An amplitude (A) of the first wave profile can have a relationship with the diameter (D) of the golf ball, a golf ball cased core, and/or a golf ball sub-assembly. In one example, the amplitude (A) can be no greater than 40% of a diameter (D) of the golf ball, golf ball cased core, or golf ball sub-assembly. In one example, the amplitude (A) is less than 20% of a diameter (D) of the golf ball, golf ball cased core, or golf ball sub-assembly. In one example, the amplitude (A) is less than 80% of a diameter (D) of the golf ball, golf ball cased core, or golf ball sub-assembly. In one example, the amplitude (A) is at least 5% of a diameter (D) of the golf ball, golf ball cased core, or golf ball sub-assembly.

In one example, the diameter (D) can be measured as a diameter of a golf ball cased core. In another example, the diameter (D) can be measured as a diameter of a finished golf ball (i.e., cased core and cover). In another example, the diameter (D) can be measured as a diameter of a golf ball sub-assembly. The diameter (D) of a golf ball cased core or a golf ball sub-assembly can be 1.50 inches-1.70 inches in one example. In another example, the diameter (D) of the golf ball cased core or golf ball sub-assembly can be 1.600 inches-1.660 inches. In another example, the diameter (D) of the golf ball cased core or golf ball sub-assembly can be 1.630 inches.

The first wave profile can be formed according to a variety of wave profiles. For example, the wave profile can be one of: a sine wave, a sawtooth wave, a triangular wave, or a square wave. In one example, multiple wave forms can be combined. In one example, the wave profile can be defined by at least one function. In one example, the wave profile can be defined by any Fourier series. One of ordinary skill in the art would recognize that wave profiles can be conveyed or defined as an infinite sum of trigonometric functions based on a Fourier series. Additionally, the wave profiles can be defined by a Fourier transform for aperiodic profiles or functions. In other examples, the wave profile can be defined by a damped wave profile (i.e., a damped sine wave profile) or any other damped oscillation, profile, or function.

The at least one radar detectable mark can be disposed on a single layer in one example. In another example, the at least one radar detectable mark can be comprised of a plurality of radar detectable marks that are disposed among more than one layer.

The projected pattern can be formed as a continuous, uninterrupted strip, in one example. In another example, the projected pattern can be formed as a plurality of discrete strips that are spaced apart from each other and aligned with each other such that the discrete strips collectively define the wave profile.

Various parameters, sizes, profiles, shapes, etc., of the wave profile and the radar detectable mark can vary. In one example, the at least one radar detectable mark can have a width of 1.0 mm-5.0 mm. In one example, the first wave profile can have an amplitude of 7.0 mm-15.0 mm. In one example, the width of the radar detectable mark can be less than 20% of the amplitude of the wave profile. In another example, the width of the radar detectable mark can be 10%-40% of the amplitude of the wave profile. In another example, the width of the radar detectable mark can be 5%-25% of the amplitude of the wave profile.

The projected pattern can further comprise a second wave profile with at least one second crest and at least one second trough. The first wave profile can be comprised of a plurality of first points and the second wave profile can be comprised of a plurality of second points. Each first point along the first wave profile and each closest adjacent second point along the second wave profile can be equidistant from each other such that a uniform normal distance ($d_N$) is defined along an entirety of the first wave profile and the second wave profile. The uniform normal distance ($d_N$) can be 4.0 mm-6.0 mm. In one aspect, the term uniform normal distance as used in this context can account for relatively minor manufacturing tolerances, variances, or deviations. For example, the phrase "uniform normal distance" can mean all of the normal distances as measured along any respective pair of adjacent points along the entirety of the wave profiles are within 5% of each other. In another example, uniform normal distance can mean all of the normal distances as measured along any respective pair of adjacent points along the entirety of the wave profiles are within 10% of each other. In another example, uniform normal distance can mean all of the normal distances as measured along any respective pair of adjacent points along the entirety of the wave profiles are within 1.0 mm of each other. In yet another example, uniform normal distance can mean all of the normal distances as measured along any respective pair of adjacent points along the entirety of the wave profiles are within 0.5 mm of each other.

The first wave profile and the second wave profile can each have a predetermined amplitude that is identical to each other, such that the uniform normal distance is at least half of the predetermined amplitude, and the uniform normal distance is no greater than twice the predetermined amplitude. In another example, a normal distance between the two wave profiles can vary.

The uniform normal distance ($d_N$) can be at least 50% of the amplitudes (A) of the wave profiles, and can be less than 200% of the amplitudes (A) of the wave profiles. In one example, the uniform normal distance and the amplitudes of both the first and second wave profiles (A) can be: $0.5*A \leq d_N \leq 2*A$.

The second wave profile can be mapped along a path defined by a second spherical arc that is positioned away from the first spherical arc. The spacing between the first and second spherical arcs can correspond to the uniform normal distance ($d_N$).

In one aspect, a relationship can be established between a number of waves and a number of periods defined by the waves. For example, a projected pattern defined by a single wave can extend for a single period. A projected pattern defined by two waves can extend for two periods. A projected pattern defined by "n" number of waves can extend for "n" periods, and so on. In one aspect, increasing the quantity of wave profiles can further optimize radar reflectivity, alter signal strength, and/or create phase shifts in signal backscatter.

The at least one radar detectable mark can have a total length of 4.0 inches-10.0 inches, in one example. In another example, the at least one radar detectable mark can have a total length of 6.0 inches-8.0 inches. In another example, the at least one radar detectable mark can have a total length of at least 2.0 inches. In another example, the at least one radar detectable mark can have a total length of no greater than 12.0 inches.

The marks can have a total surface coverage of at least 3.0% and no greater than 15.0% in some examples. In this context, total surface coverage can refer to a surface upon which the marks are printed or applied. The total surface coverage can refer to an outer surface of the golf ball, an outer surface of the golf ball cased core, or an outer surface of the golf ball sub-assembly.

Another example of a golf ball is disclosed herein. The golf ball can have at least one radar detectable mark such that a projected pattern is formed when the at least one radar detectable mark is radially projected onto an outer surface of the golf ball. The projected pattern can comprise a first wave profile defined by a periodic function and mapped along a path defined by a first spherical arc on the outer surface of the golf ball. The periodic function can be selected from: a sine wave, a sawtooth wave, a triangle wave, or a square wave. The periodic function can repeat for at least 1.0 period. The projected pattern can further include a second wave profile with at least one second crest and at least one second trough. A uniform normal distance can be defined along an entirety of the first wave profile and the second wave profile. The first wave profile can have a first amplitude, and the second wave profile can have a second amplitude. The uniform normal distance can be less than half of the first amplitude. The uniform normal distance can be less than half of the second amplitude. The first amplitude can be no greater than 40% of a diameter of the golf ball.

In one example, a golf ball having an ionomeric cased core having a diameter of 1.63 inches can include a printed sinusoidal wave pattern with a marking width of 2.0 mm and a wave profile amplitude of 15.0 mm. The wave angular extent can extend for at least 270 degrees. The wave pattern can be formed on the cased core of the golf ball. The wave pattern can be formed on any layer(s) of a golf ball sub-assembly, in one example.

In another example, a golf ball having an ionomeric cased core having a diameter of 1.63 inches can include a pair of printed sinusoidal wave patterns with a marking width of 2.0 mm and a wave profile amplitude of 7.0 mm. Each of the waves can have a wave angular extent that extends for at least 270 degrees. The waves can be separated by a constant or uniform normal distance of 5.0 mm.

In another example, a golf ball having an ionomeric cased core having a diameter of 1.63 inches can include a pair of printed step-function patterns with a marking width of 2.0 mm and a step-function amplitude of 7.0 mm. Each of the waves can have a wave angular extent that extends for at least 270 degrees. The patterns can be separated by a constant or uniform normal distance of 5.0 mm.

In another example, a golf ball having an ionomeric cased core having a diameter of 1.63 inches can include a pair of printed triangular wave patterns with a marking width of 2.0 mm and a wave profile amplitude of 7.0 mm. Each of the waves can have a wave angular extent that extends for at least 270 degrees. The patterns can be separated by a constant or uniform normal distance of 5.0 mm.

In any of the above examples, one of ordinary skill in the art would understand that the size of the golf ball can vary, the marking width can vary, the amplitude can vary, etc.

As used in this context, the term amplitude can refer to peak amplitude, i.e., a maximum distance from the zero position or axis of the pattern profiles.

Another example of a golf ball is also disclosed herein. The golf ball can have at least one radar detectable mark such that a projected pattern is formed when the at least one radar detectable mark is radially projected onto an outer surface of the golf ball. The projected pattern can comprise a first wave profile defined by a periodic function and mapped along a path defined by a first spherical arc on the outer surface of the golf ball. The periodic function can be a sine wave, and the periodic function can repeat for at least 1.0 period.

Non-limiting examples of particularly suitable shapes for a single radar detectable mark or a plurality of radar detectable marks are illustrated in FIGS. 1-11 and 13-26E.

FIG. 1 shows a mark consisting of a stripe, according to an embodiment of the present invention.

Figure 2:
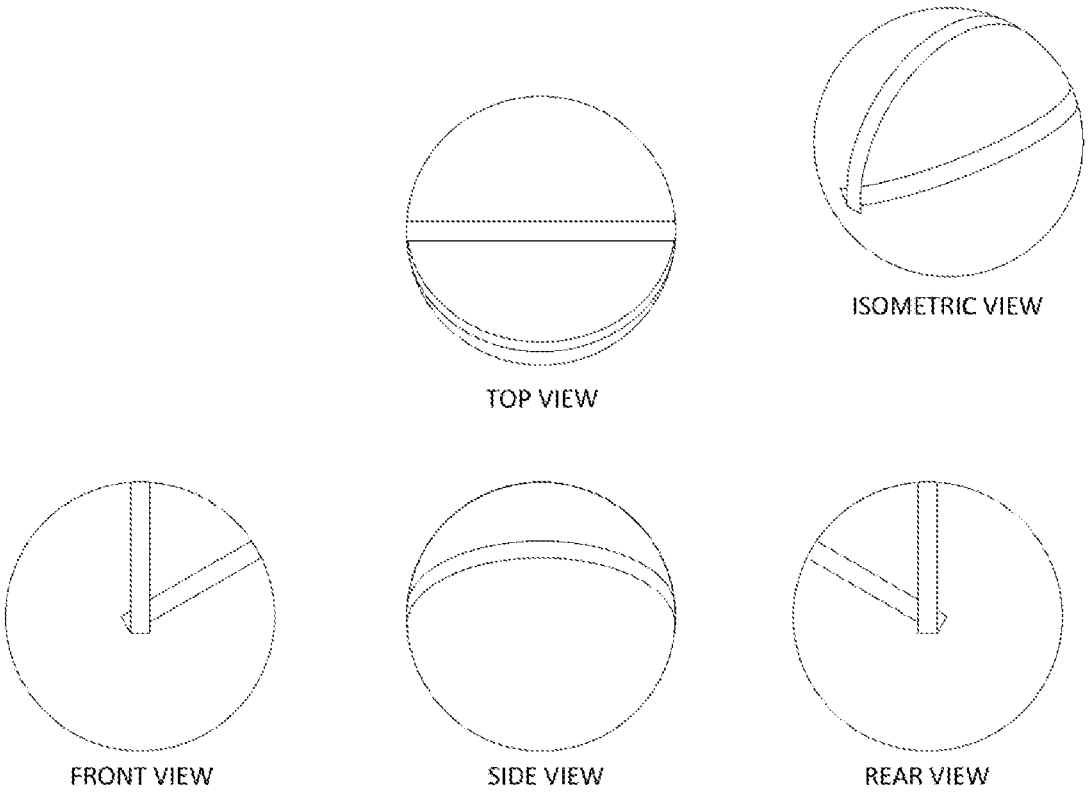
FIG. 2 illustrates a top view, an isometric view, a front view, a side view, and a rear view of a mark, according to an embodiment of the present invention.

FIG. 2 shows a mark consisting of two stripes intersecting at two locations, according to an embodiment of the present invention.

Figure 3:
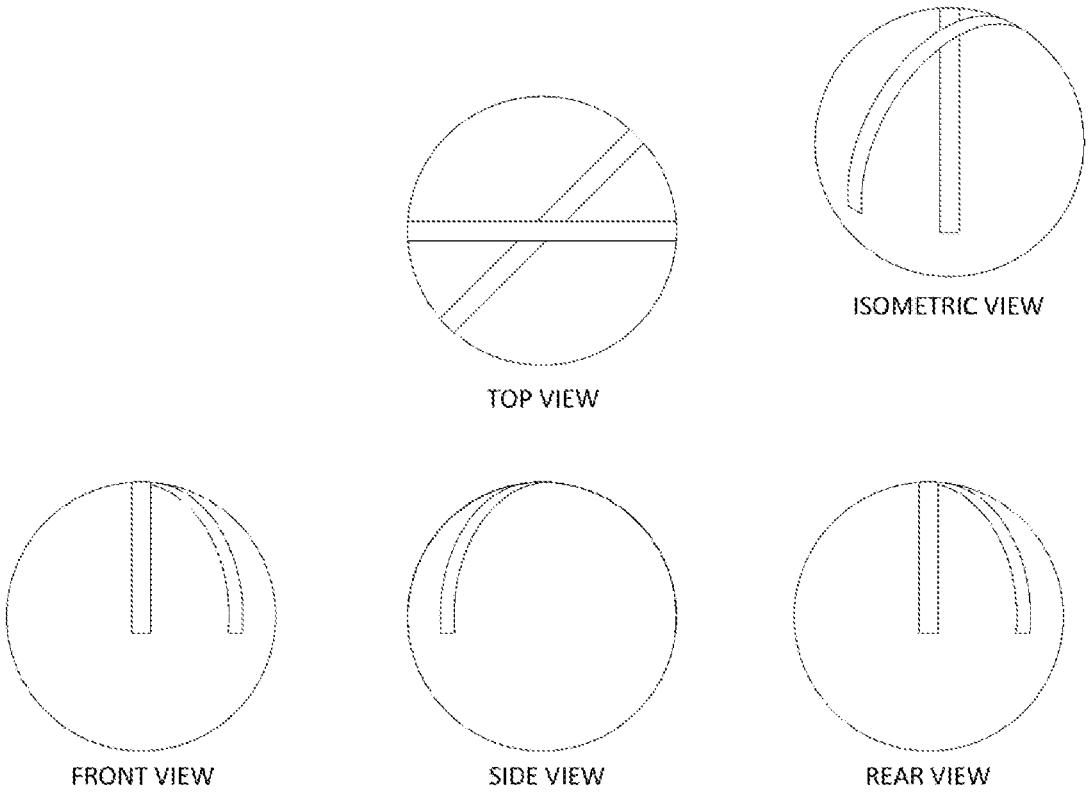
FIG. 3 illustrates a top view, an isometric view, a front view, a side view, and a rear view of a mark, according to an embodiment of the present invention.

FIG. 3 shows a mark consisting of two stripes intersecting at one location, according to an embodiment of the present invention.

Figure 4:
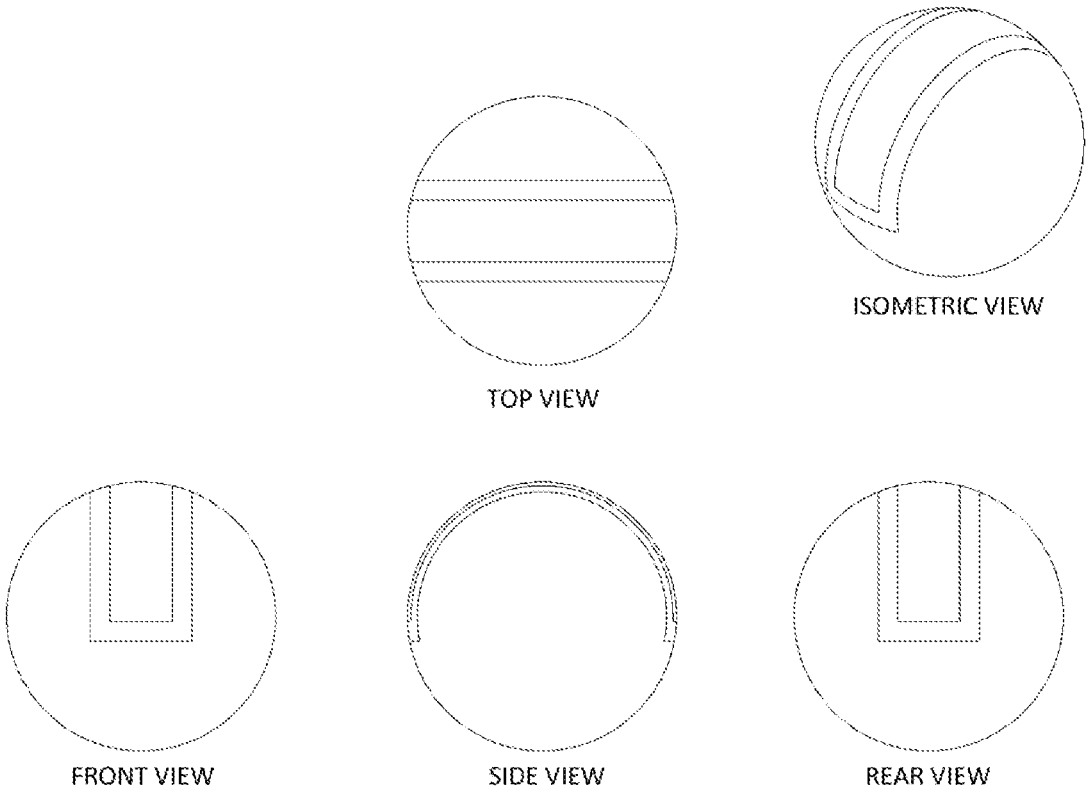
FIG. 4 illustrates a top view, an isometric view, a front view, a side view, and a rear view of a mark, according to an embodiment of the present invention.

FIG. 4 shows a mark consisting of four stripes forming a closed loop in the form of a spherical rectangle, according to an embodiment of the present invention.

Figure 5:
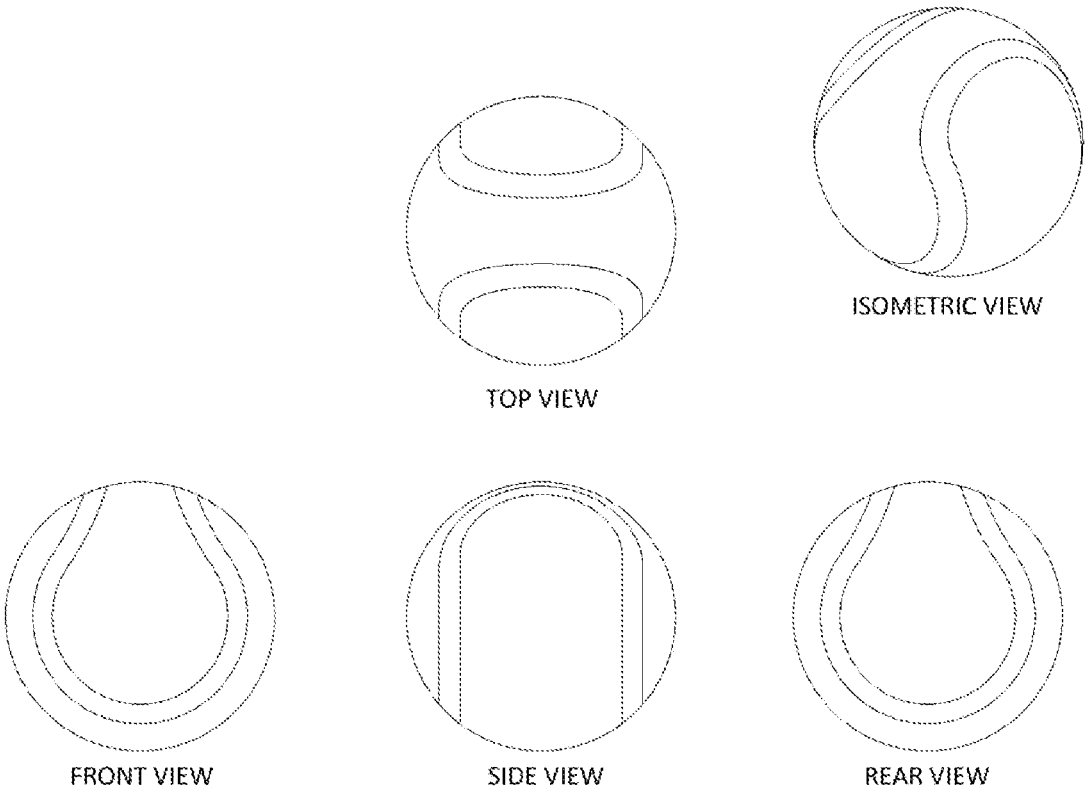
FIG. 5 illustrates a top view, an isometric view, a front view, a side view, and a rear view of a mark, according to an embodiment of the present invention.

FIG. 5 shows a mark consisting of a single curvilinear stripe creating a closed loop, according to an embodiment of the present invention.

Figure 6:
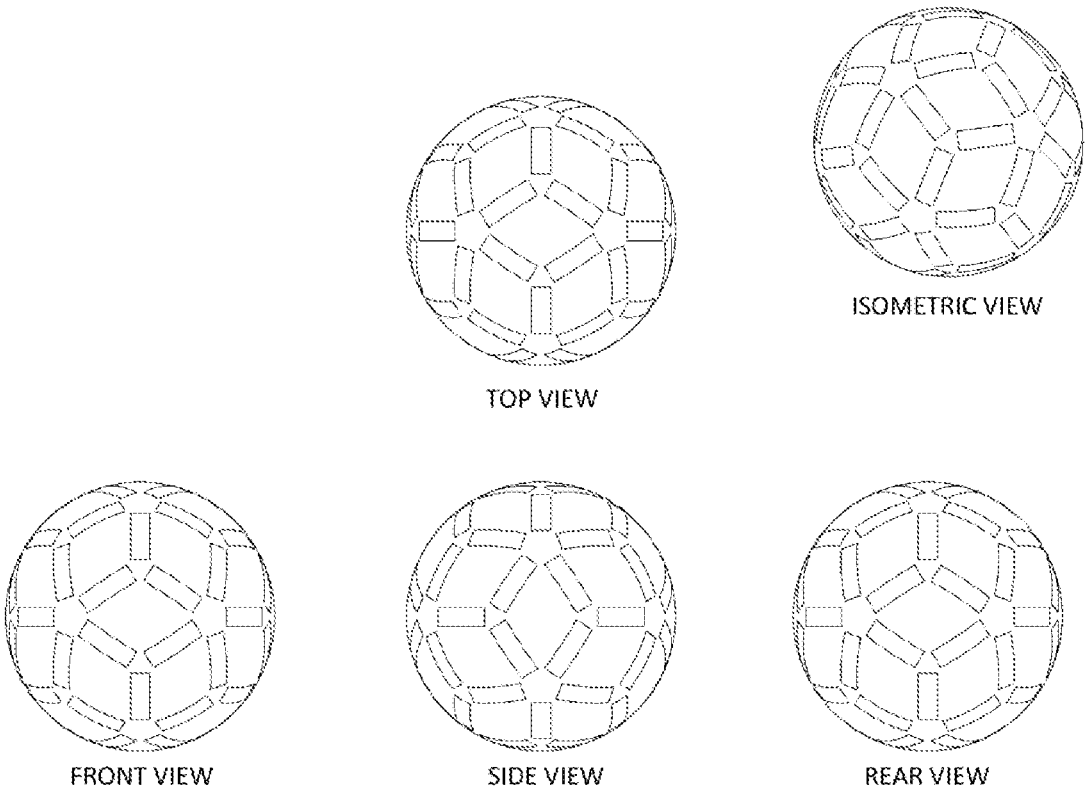
FIG. 6 illustrates a top view, an isometric view, a front view, a side view, and a rear view of a mark, according to an embodiment of the present invention.

FIG. 6 shows a plurality of marks consisting of stripes arranged in an icosahedral pattern, according to an embodiment of the present invention, the stripes having substantially the same length and width. Alternatively, the stripes are arranged in an icosahedral pattern and adjoined to form a continuous mark, according to an embodiment of the present invention.

Figure 7:
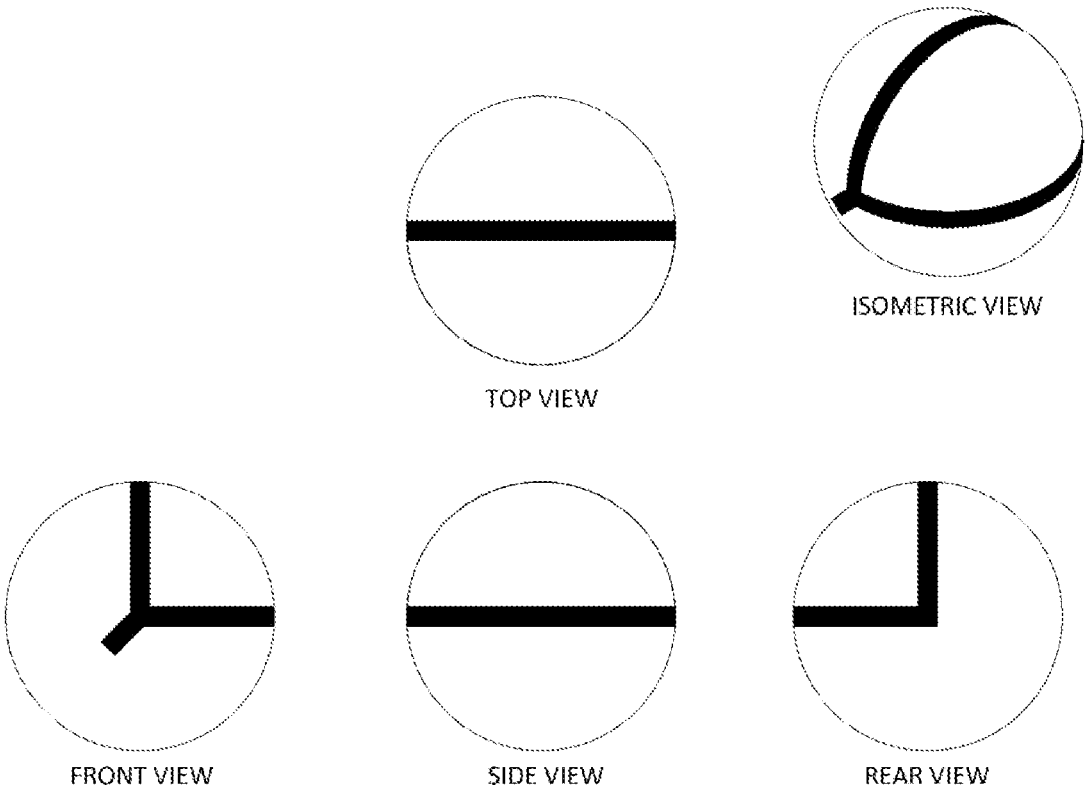
FIG. 7 illustrates a top view, an isometric view, a front view, a side view, and a rear view of a mark, according to an embodiment of the present invention.

FIG. 7 shows a mark consisting of three intersecting stripes, according to an embodiment of the present invention.

Figure 8:
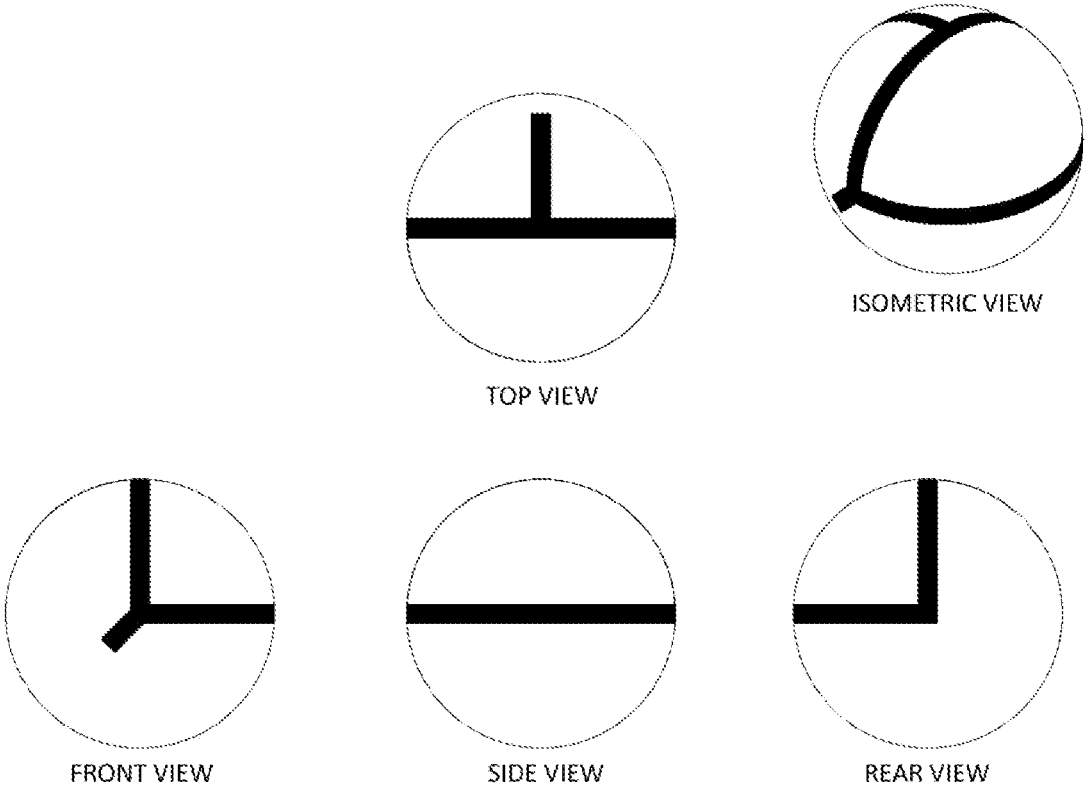
FIG. 8 illustrates a top view, an isometric view, a front view, a side view, and a rear view of a mark, according to an embodiment of the present invention.

FIG. 8 shows a mark consisting of four intersecting stripes, according to an embodiment of the present invention.

Figure 9:
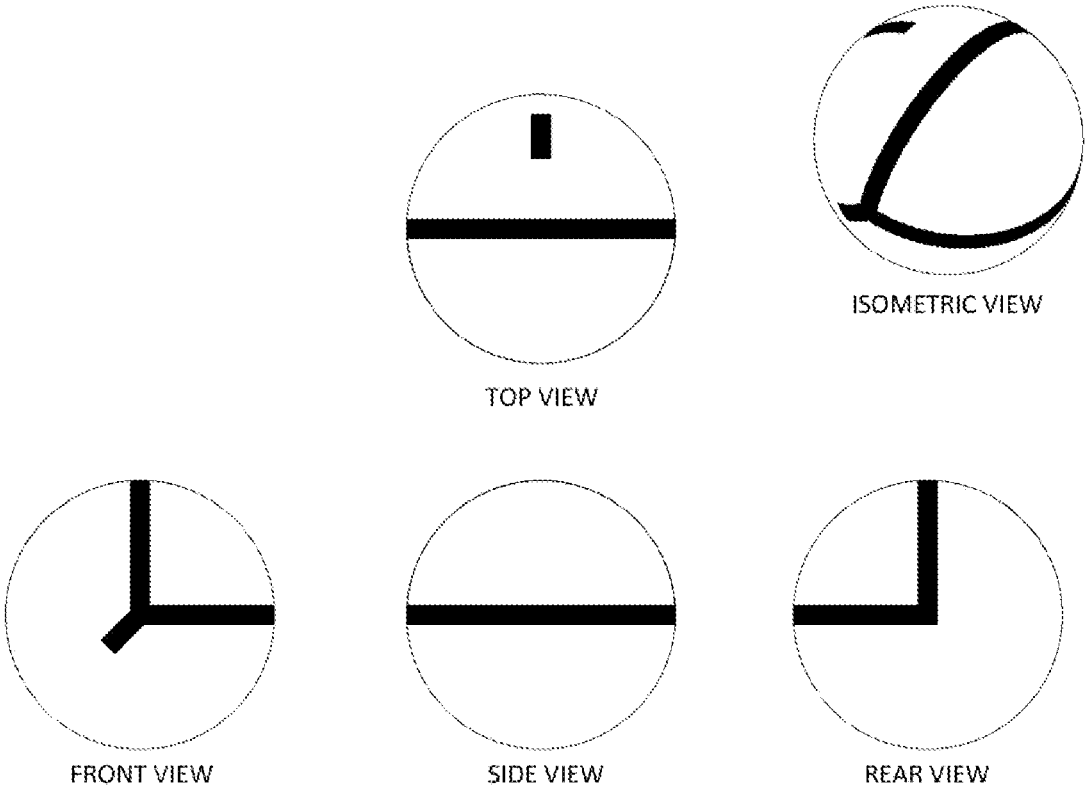
FIG. 9 illustrates a top view, an isometric view, a front view, a side view, and a rear view of a mark, according to an embodiment of the present invention.

FIG. 9 shows two marks, including a first mark consisting of three intersecting stripes and a second mark consisting of a single stripe, according to an embodiment of the present invention.

Figure 10:
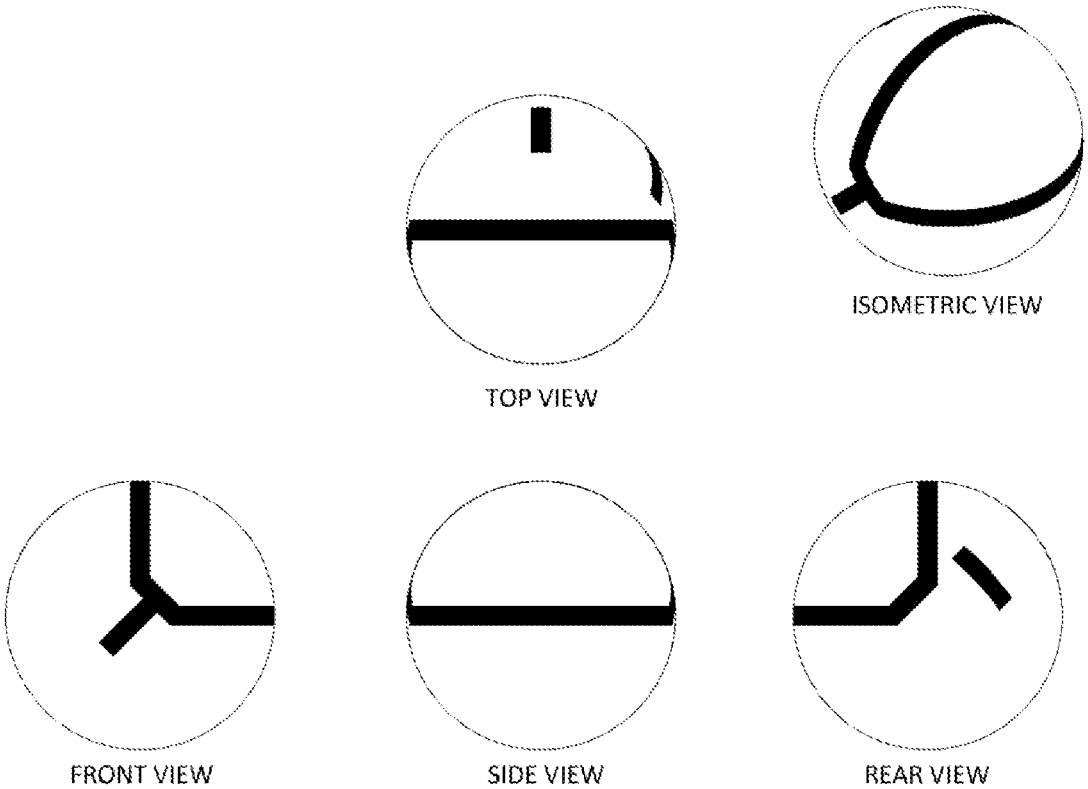
FIG. 10 illustrates a top view, an isometric view, a front view, a side view, and a rear view of a mark, according to an embodiment of the present invention.

FIG. 10 shows three marks, including a first mark consisting of five intersecting stripes, a second mark consisting of a single stripe, and a third mark consisting of a single stripe, according to an embodiment of the present invention.

Figure 11:
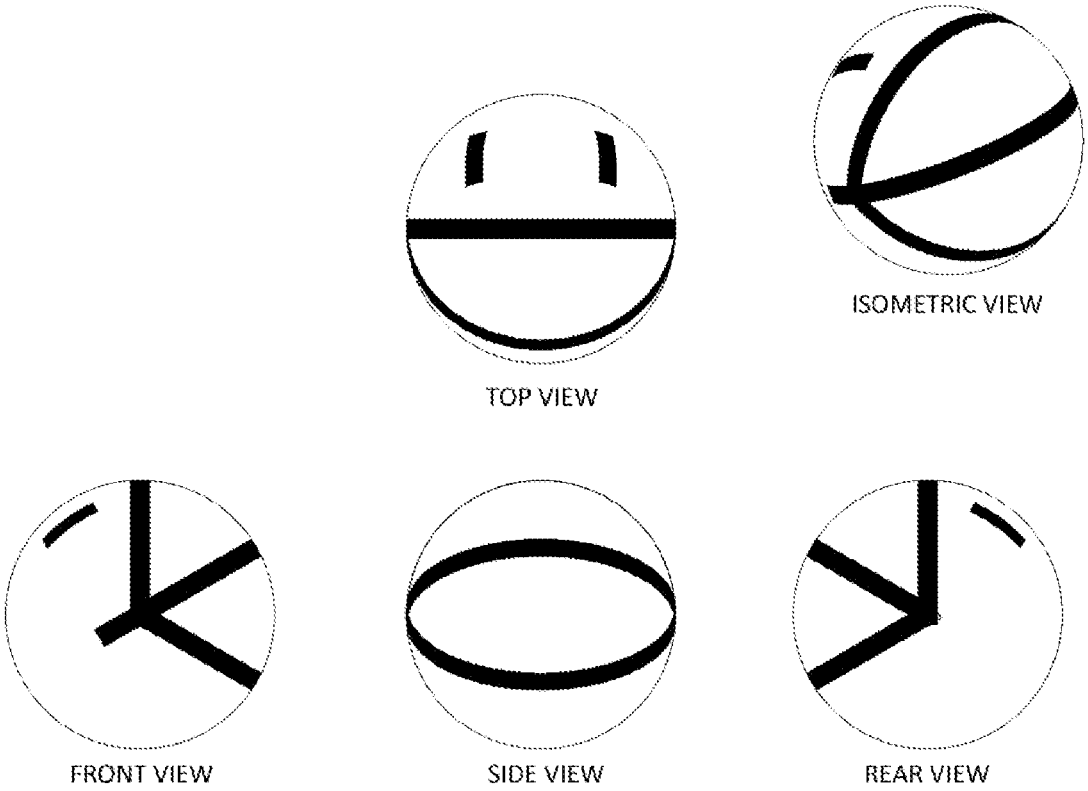
FIG. 11 illustrates a top view, an isometric view, a front view, a side view, and a rear view of a mark, according to an embodiment of the present invention.

FIG. 11 shows three marks, including a first mark consisting of four intersecting stripes, a second mark consisting of a single stripe, and a third mark consisting of a single stripe, according to an embodiment of the present invention.

Figure 13:
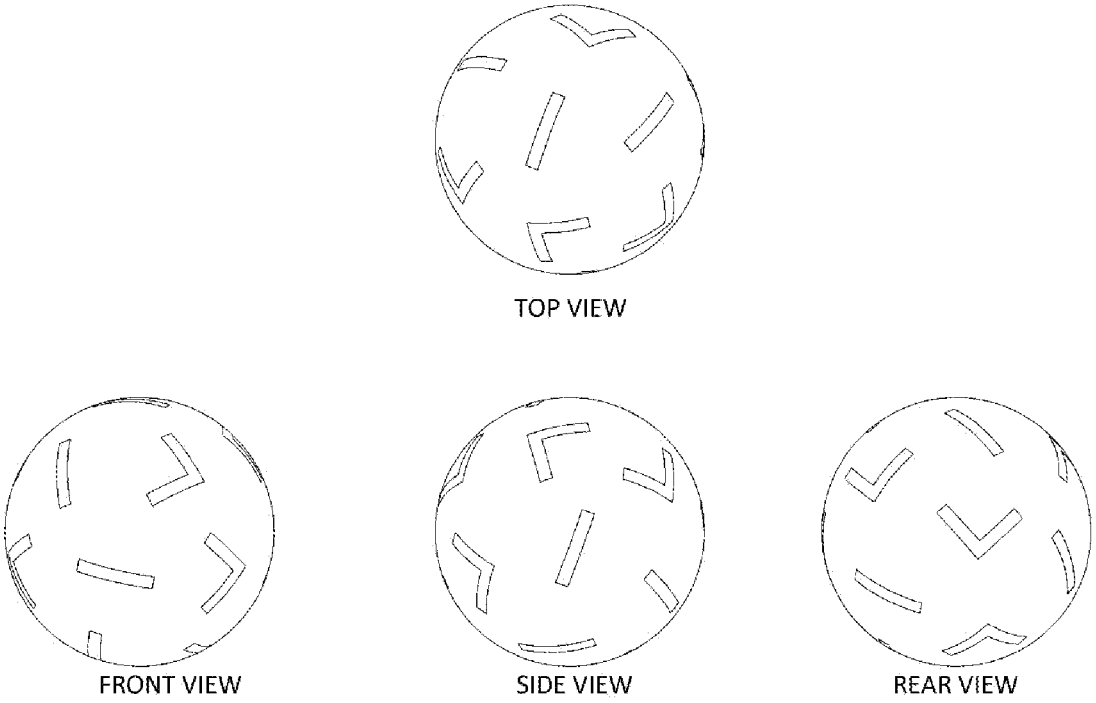
FIG. 13 illustrates a top view, a front view, a side view, and a rear view of a marking pattern, according to an embodiment of the present invention.

FIG. 13 shows a pattern of marks consisting of a plurality of marks having the shape of a rectangle and a plurality of marks having the shape of two intersecting rectangular stripes.

Figure 14:
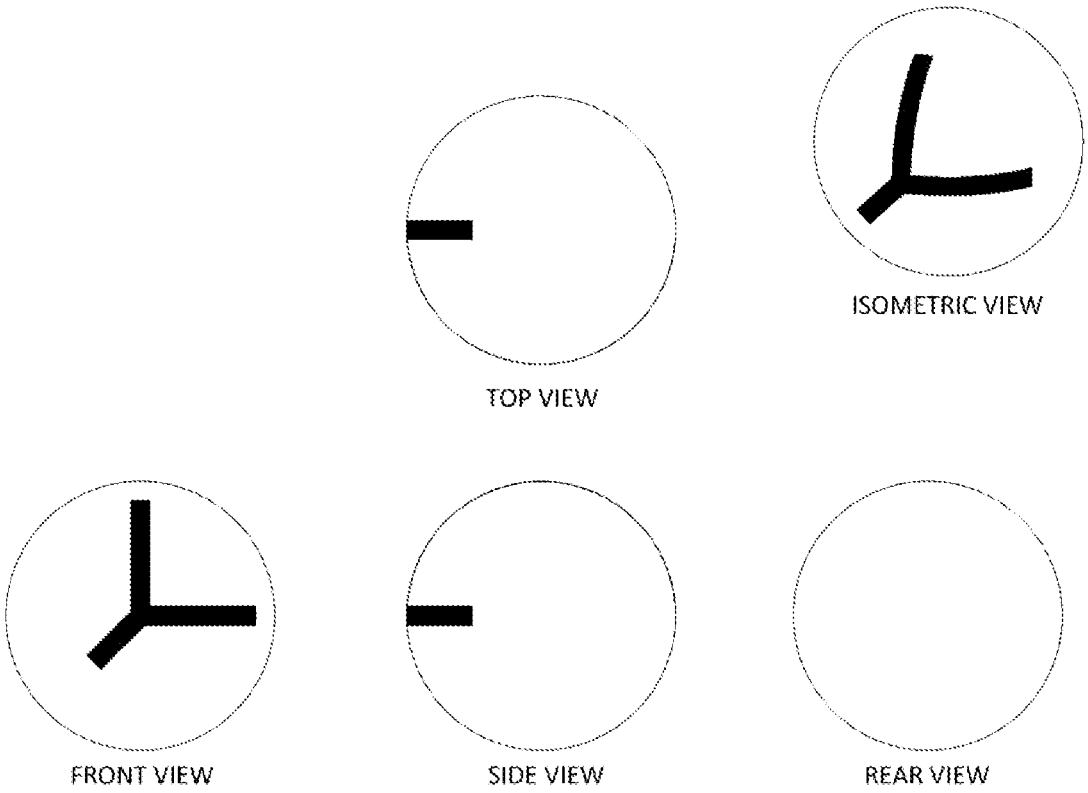
FIG. 14 illustrates a top view, an isometric view, a front view, a side view, and a rear view of a marking pattern, according to an embodiment of the present invention.

FIG. 14 shows a mark consisting of three intersecting stripes, according to an embodiment of the present invention.

Figure 15:
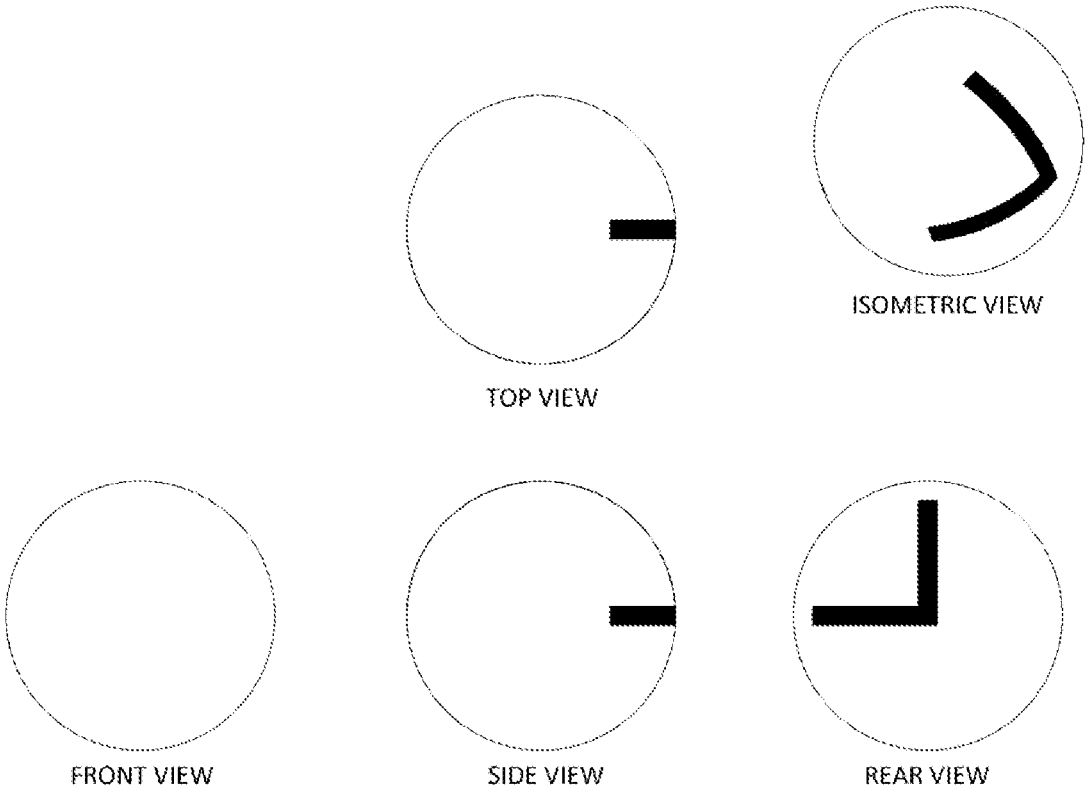
FIG. 15 illustrates a top view, an isometric view, a front view, a side view, and a rear view of a marking pattern, according to an embodiment of the present invention.

FIG. 15 shows a mark consisting of two intersecting stripes, according to an embodiment of the present invention.

Figure 16:
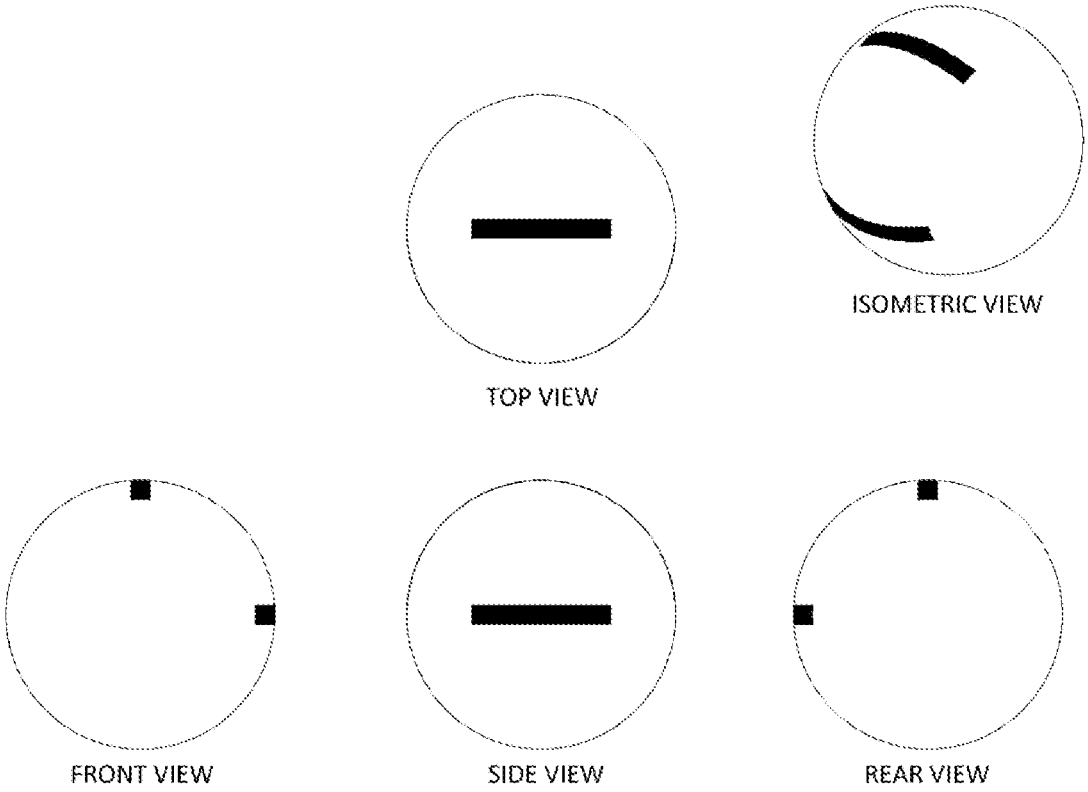
FIG. 16 illustrates a top view, an isometric view, a front view, a side view, and a rear view of a marking pattern, according to an embodiment of the present invention.

FIG. 16 shows a mark consisting of two non-intersecting stripes, according to an embodiment of the present invention.

FIG. 17 shows a pattern of marks consisting of two great circle series of marks, each of which consists of a plurality of marks having the shape of a stripe.

Figure 18:
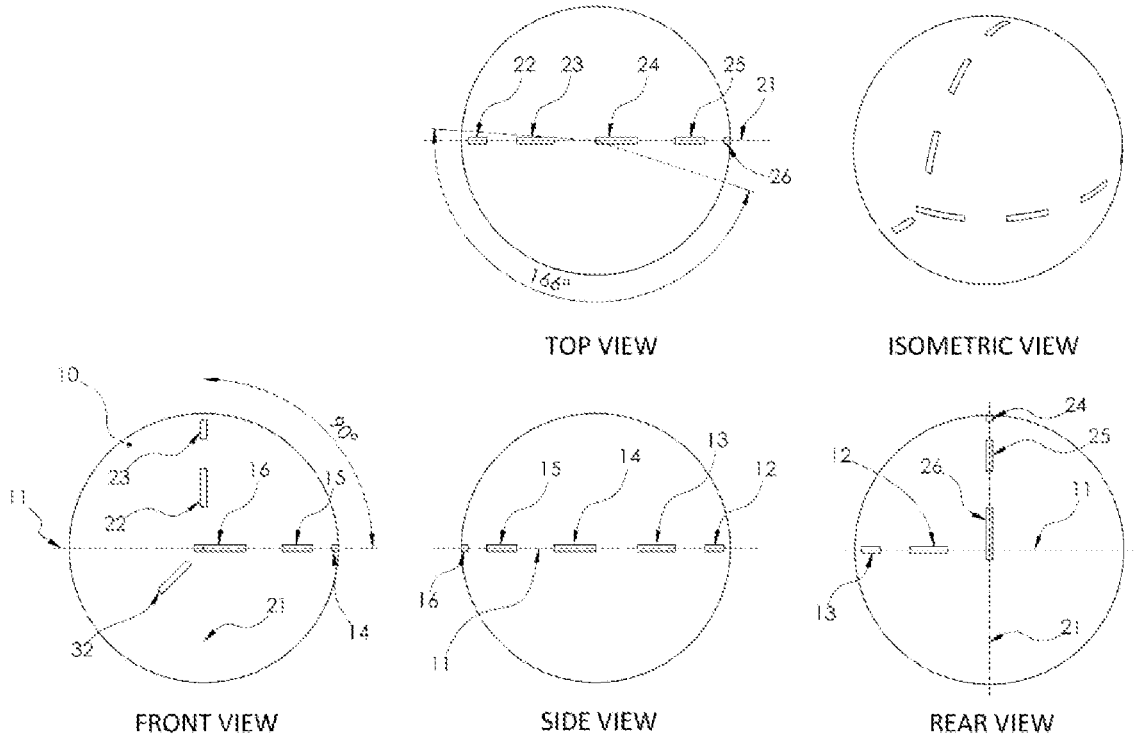
FIG. 18 illustrates a top view, an isometric view, a front view, a side view, and a rear view of a marking pattern, according to an embodiment of the present invention.

FIG. 18 shows a pattern of marks consisting of two great circle series of marks and an additional mark that is not part of a great circle series, each of the marks within the two great circle series and the additional mark having the shape of a stripe.

FIGS. 19A-19E show a pattern consisting of a mark that extends circumferentially along a spherical arc with a wave profile (i.e., sine wave).

FIGS. 20A-20E show a pattern consisting of two marks that each extend circumferentially along a respective spherical arc with wave profiles (i.e., sine waves).

FIGS. 21A-21E show a pattern consisting of a mark that extends circumferentially along a spherical arc with a wave profile (i.e., sine wave) having an amplitude that is different than the amplitude shown in FIGS. 19A-19E.

FIGS. 22A-22E show a pattern consisting of two marks that each extend circumferentially along a respective spherical arc with wave profiles (i.e., sine waves) having an amplitude that is different than the amplitude shown in FIGS. 20A-20E.

FIGS. 23A-23D show a pattern consisting of a mark that extends circumferentially along a spherical arc with a wave profile (i.e., triangular wave).

FIGS. 24A-24D show a pattern consisting of a mark that extends circumferentially along a spherical arc with a wave profile (i.e., sawtooth wave).

FIGS. 25A-25D show a pattern consisting of a mark that extends circumferentially along a spherical arc with a wave profile (i.e., square wave).

FIGS. 26A-26E show a pattern consisting of a plurality of marks that are spaced apart from each other and aligned with each other to form an overall wave shaped pattern.

In a particular embodiment, a surface of at least one layer of the golf ball includes a radar detectable mark disposed thereon and the mark is designed to have dimensions (i.e., size and shape) such that every mathematically possible 0.025 inch wide great circle path, or every mathematically possible 0.015 inch wide great circle path, or every mathematically possible 0.005 inch wide great circle path, or every mathematically possible great circle, on the golf ball layer surface on which the mark is disposed intersects the mark. For purposes of the present disclosure, a great circle path intersects a mark if any portion of the great circle path is in contact with any portion of the mark.

In another particular embodiment, a surface of at least one layer of the golf ball includes a plurality of radar detectable marks disposed thereon and the marks are designed to be sized, shaped, and positioned such that every mathematically possible 0.025 inch wide great circle path, or every mathematically possible 0.015 inch wide great circle path, or every mathematically possible 0.005 inch wide great circle path, or every mathematically possible great circle, on the golf ball layer surface on which the marks are disposed intersects at least one of the marks.

In another particular embodiment, the golf ball comprises two or more layers, wherein at least two of the two or more layers have one or more radar detectable marks disposed on a surface thereof and the marks are designed to be size, shaped, and positioned such that, when all of the radar detectable marks present on any layer of the ball are radially projected onto the outer surface of the ball, every mathematically possible 0.025 inch wide great circle path, or every mathematically possible 0.015 inch wide great circle path, or every mathematically possible 0.005 inch wide great circle path, or every mathematically possible great circle, on the golf ball outer surface intersects at least one of the marks.

In another particular embodiment, the radar detectable mark(s) have a total surface coverage of 1% or 2% or 5% or 8% or 9% or 10% or 12% or 15% or 20% or 25% or a total surface coverage within a range having a lower limit and an upper limit selected from these values. Alternatively, in another particular embodiment, the radar detectable mark(s) have a total surface coverage of 0.1% or 1.0% or 1.5% or 2.0% or 3% or 4% or a total surface coverage within a range having a lower limit and an upper limit selected from these values. For purposes of the present disclosure, total surface coverage is calculated as the sum of the surface area of each radar detectable mark present on any layer, as measured with all of the marks present on the surface of any layer of the golf ball radially projected onto the outer surface of the ball, divided by the total surface area of the outer surface of the ball.

The present invention is not meant to be limited by the material used to form each layer of the golf ball. Particularly suitable materials include, but are not limited to, thermosetting materials, such as polybutadiene, styrene butadiene, isoprene, polyisoprene, and trans-isoprene; thermoplastics, such as ionomer resins, polyamides and polyesters; and thermoplastic and thermosetting polyurethane and polyureas.

Particularly suitable thermosetting materials, include, but are not limited to, thermosetting rubber compositions comprising a base polymer, an initiator agent, a coagent and/or a curing agent, and optionally one or more of a metal oxide, metal fatty acid or fatty acid, antioxidant, soft and fast agent, fillers, and additives. Suitable base polymers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polyalkenamers, and combinations of two or more thereof. Suitable initiator agents include organic peroxides, high energy radiation sources capable of generating free radicals, C-C initiators, and combinations thereof. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof. Suitable types and amounts of base polymer, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

Particularly suitable materials also include, but are not limited to:

a) thermosetting polyurethanes, polyureas, and hybrids of polyurethane and polyurea;
b) thermoplastic polyurethanes, polyureas, and hybrids of polyurethane and polyurea, including, for example, Estane® TPU, commercially available from The Lubrizol Corporation;
c) E/X- and E/X/Y-type ionomers, wherein E is an olefin (e.g., ethylene), X is a carboxylic acid (e.g., acrylic, methacrylic, crotonic, maleic, fumaric, or itaconic acid), and Y is a softening comonomer (e.g., vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons), such as Surlyn® ionomer resins and HPF 1000 and HPF 2000, commercially available from The Dow Chemical Company, Iotek® ionomers, commercially available from ExxonMobil Chemical Company, Amplify® IO ionomers of ethylene acrylic acid copolymers, commercially available from The Dow Chemical Company, and Clarix® ionomer resins, commercially available from A. Schulman Inc.;
d) polyisoprene;
e) polyoctenamer, such as Vestenamer® polyoctenamer, commercially available from Evonik Industries;
f) polyethylene, including, for example, low density polyethylene, linear low density polyethylene, and high density polyethylene; polypropylene;
g) rubber-toughened olefin polymers; non-ionomeric acid copolymers, e.g., (meth)acrylic acid, which do not become part of an ionomeric copolymer;
h) plastomers;
i) flexomers;
j) styrene/butadiene/styrene block copolymers;
k) styrene/ethylene-butylene/styrene block copolymers;
l) polybutadiene;
m) styrene butadiene rubber;
n) ethylene propylene rubber;
o) ethylene propylene diene rubber;
p) dynamically vulcanized elastomers;
q) ethylene vinyl acetates;
r) ethylene (meth) acrylates;
s) polyvinyl chloride resins;
t) polyamides, amide-ester elastomers, and copolymers of ionomer and polyamide, including, for example, Pebax® thermoplastic polyether and polyester amides, commercially available from Arkema Inc;
u) crosslinked trans-polyisoprene;
v) polyester-based thermoplastic elastomers, such as Hytrel® polyester elastomers, commercially available from E. I. du Pont de Nemours and Company, and Riteflex® polyester elastomers, commercially available from Ticona;
w) polyurethane-based thermoplastic elastomers, such as Elastollan® polyurethanes, commercially available from BASF;

x) synthetic or natural vulcanized rubber;

y) and combinations thereof.

Compositions comprising an ionomer or a blend of two or more E/X- and E/X/Y-type ionomers are particularly suitable intermediate and cover layer materials. Preferred E/X- and E/X/Y-type ionomeric cover compositions include:

(a) a composition comprising a "high acid ionomer" (i.e., having an acid content of greater than 16 wt %), such as Surlyn® 8150;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn® 8150 and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9120), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140 or 8150, 40-50 wt % Surlyn® 9120, and 0-10 wt % Surlyn® 6320).

Surlyn 8150®, Surlyn® 8940, and Surlyn® 8140 are different grades of E/MAA copolymer in which the acid groups have been partially neutralized with sodium ions. Surlyn® 9650, Surlyn® 9910, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from The Dow Chemical Company.

Suitable E/X- and E/X/Y-type ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Suitable polyurethanes, polyureas, and blends and hybrids of polyurethane/polyurea are further disclosed, for example, in U.S. Pat. Nos. 5,334,673, 5,484,870, 6,506,851, 6,756,436, 6,835,794, 6,867,279, 6,960,630, and 7,105,623; U.S. Patent Application Publication No. 2009/0011868; U.S. Patent Application Publication No. 2021/0093929; U.S. Patent Application Publication No. 2007/0117923; and U.S. Pat. Nos. 8,865,052, 6,734,273, and 8,034,873; the entire disclosures of which are hereby incorporated herein by reference.

Suitable UV absorbers that are optionally included in cover layer compositions are further disclosed, for example, in U.S. Pat. No. 5,156,405 to Kitaoh; U.S. Pat. No. 5,840,788 to Lutz; and U.S. Pat. No. 7,722,483 to Morgan; the entire disclosures of which are hereby incorporated herein by reference.

Dimensions of each golf ball layer, i.e., thickness/diameter, may vary depending on the desired properties.

The United States Golf Association specifications limit the minimum size of a competition golf ball to 1.680 inches. There is no specification as to the maximum diameter, and golf balls of any size can be used for recreational play. Golf balls of the present invention can have an overall diameter of any size, and, typically, have an overall diameter of from 1.680 inches to 1.780 inches.

Golf balls of the present invention have a plurality of dimples on the outer surface thereof, and, typically, have an overall dimple surface coverage of 60% or greater, or 65% or greater, or 75% or greater or 80% or greater.

EXAMPLES

It should be understood that the examples below are merely illustrative of particular embodiments of the present invention, and are not to be construed as limiting the invention, the scope of which is defined by the appended claims.

In each of Examples 1-29 below, a golf ball subassembly having a diameter of about 1.630 inches and consisting of a solid rubber core and an ionomer casing layer was provided. A mark, or a plurality of marks, as indicated below, was pad printed on the outer surface of each subassembly using electrically conductive ink to produce a marked subassembly.

Example 1

In this example, the mark consists of a single stripe, according to the embodiment illustrated in FIG. 1. The stripe has a width of about 0.120 inches and a length of about 2.750 inches. Every mathematically possible 0.025 inch wide great circle path on the spherical outer surface of the casing intersects the mark.

Example 2

In this example, the mark consists of two stripes intersecting at two locations, according to the embodiment illustrated in FIG. 2. The stripes are substantially equal in size, each stripe having a width of about 0.120 inches and a length of about 2.750 inches. Every mathematically possible 0.025 inch wide great circle path on the spherical outer surface of the casing intersects the mark.

Example 3

In this example, the mark consists of two stripes intersecting at one location, according to the embodiment illustrated in FIG. 3. The stripes are substantially equal in size, each stripe having a width of about 0.120 inches and a length of about 2.750 inches. Every mathematically possible 0.025 inch wide great circle path on the spherical outer surface of the casing intersects the mark.

Example 4

In this example, the mark consists of four stripes forming a closed loop in the form of a spherical rectangle, according to the embodiment illustrated in FIG. 4. The stripes are substantially equal in width, each stripe having a width of about 0.120 inches. Each of the two stripes forming the long sides of the spherical rectangle has a length of about 2.670 inches, and each of the two stripes forming the short sides of the spherical rectangle has a length of about 0.380 inches. Every mathematically possible 0.025 inch wide great circle path on the spherical outer surface of the casing intersects the mark.

Example 5

In this example, the mark consists of a single curvilinear stripe creating a closed loop, according to the embodiment illustrated in FIG. 5. The stripe has a width of about 0.120 inches. The closed loop has a length of about 8.390 inches. Every mathematically possible 0.025 inch wide great circle path on the spherical outer surface of the casing intersects the mark.

Example 6

In this example, the plurality of marks consists of sixty stripes arranged in an icosahedral pattern, according to the embodiment illustrated in FIG. 6. The stripes are substantially equal in size, each stripe having a width of about 0.120 inches and a length of about 0.350 inches. Every mathematically possible 0.025 inch wide great circle path on the spherical outer surface of the casing intersects the mark.

Example 7

In this example, the mark consists of three intersecting stripes according to the embodiment illustrated in FIG. 7. The first stripe and the second stripe have substantially the same length, each of the first stripe and the second stripe having a length of about 2.60 inches. The third stripe has a length of about 0.25 inches. The first stripe, the second stripe, and the third stripe have substantially the same width, each stripe having a width of about 0.12 inches. The mark has an average width of about 0.12 inches. A plane bisecting the first stripe and a plane bisecting the second stripe are separated by an angle of about 90°, as illustrated in the front view and the rear view of FIG. 7. The mark has a total surface coverage of about 8%.

Example 8

In this example, the mark consists of four intersecting stripes, according to the embodiment illustrated in FIG. 8. The first stripe and the second stripe have substantially the same length, each of the first stripe and the second stripe having a length of about 2.60 inches. The third stripe has a length of about 0.25 inches. The fourth stripe has a length of about 0.75 inches. The first stripe, the second stripe, the third stripe, and the fourth stripe have substantially the same width, each stripe having a width of about 0.12 inches. The mark has an average width of about 0.12 inches. A plane bisecting the first stripe and a plane bisecting the second stripe are separated by an angle of about 90°, as illustrated in the front view and the rear view of FIG. 8. The mark has a total surface coverage of about 9%

Example 9

In this example, the plurality of marks consists of a first mark and a second mark, according to the embodiment illustrated in FIG. 9.

The first mark consists of three intersecting stripes, including a first stripe, a second stripe, and a third stripe. The first stripe and the second stripe of the first mark have substantially the same length, each of the first stripe and the second stripe having a length of about 2.60 inches. The third stripe of the first mark has a length of about 0.25 inches. The first stripe, the second stripe, and the third stripe of the first mark have substantially the same width, each stripe of the first mark having a width of about 0.12 inches. The first mark has an average width of about 0.12 inches. A plane bisecting the first stripe and a plane bisecting the second stripe are separated by an angle of about 90°, as illustrated in the front view and the rear view of FIG. 9.

The second mark consists of a single stripe having a length of about 0.40 inches and a width of about 0.12 inches.

The plurality of marks has a total surface coverage of about 8%.

Example 10

In this example, the plurality of marks consists of a first mark, a second mark, and a third mark, according to the embodiment illustrated in FIG. 10.

The first mark consists of five intersecting stripes, including a first stripe, a second stripe, a third stripe, a fourth stripe, and a fifth stripe. The first stripe and the second stripe of the first mark have substantially the same length, each of the first stripe and the second stripe having a length of about 2.15 inches. The third stripe and the fourth stripe of the first mark connect the ends of the first and second stripes. The third stripe and the fourth stripe of the first mark have substantially the same length, each of the third stripe and the fourth stripe having a length of about 0.30 inches. The fifth stripe of the first mark has a length of about 0.40 inches. The first stripe, the second stripe, the third stripe, the fourth stripe, and the fifth stripe of the first mark have substantially the same width, each stripe of the first mark having a width of about 0.12 inches. The first mark has an average width of about 0.12 inches. A plane bisecting the first stripe and a plane bisecting the second stripe are separated by an angle of about 90°, as illustrated in the front view and the rear view of FIG. 10.

The second mark consists of a single stripe having a length of about 0.40 inches and a width of about 0.12 inches.

The third mark consists of a single stripe having a length of about 0.40 inches and a width of about 0.12 inches.

The plurality of marks has a total surface coverage of about 9%

Example 11

In this example, the plurality of marks consists of a first mark, a second mark, and a third mark, according to the embodiment illustrated in FIG. 11.

The first mark consists of four intersecting stripes, including a first stripe, a second stripe, a third stripe, and a fourth stripe. The first stripe, the second stripe, and the third stripe of the first mark have substantially the same length, each of the first stripe, the second stripe, and the third stripe having a length of about 2.50 inches. The fourth stripe of the first mark has a length of about 0.25 inches. The first stripe, the second stripe, the third stripe, and the fourth stripe of the first mark have substantially the same width, each stripe of the first mark having a width of about 0.12 inches. The first mark has an average width of about 0.12 inches. A plane bisecting the first stripe and a plane bisecting the second stripe are separated by an angle of about 60°, as illustrated in the front view and the rear view of FIG. 11. A plane bisecting the second stripe and a plane bisecting the third stripe are separated by an angle of about 60°, as illustrated in the front view and the rear view of FIG. 11.

The second mark consists of a single stripe having a length of about 0.40 inches and a width of about 0.12 inches.

The third mark consists of a single stripe having a length of about 0.40 inches and a width of about 0.12 inches.

The plurality of marks has a total surface coverage of about 12%.

In each of examples 1-11 above, a finished golf ball was formed by molding a cover layer about the marked subassembly. The finished golf balls were repeatedly fired via air cannon to a mass plate, simulating golf ball driver impact speed greater than 175 miles per hour. Subsequent to repeated testing, the balls were tested using a mechanical robot swinging a driver. The average launch condition for the balls was 175 mph, 9.5 degrees, 2600 rpm, as measured using a photogrammetric system. The radar tracking system was able to accurately measure spin at a capture rate of greater than 96% utilizing 16 feet of ball flight. The radar tracking system used for testing was a TrackMan golf radar, commercially available from TrackMan Golf, with the TrackMan set to indoor mode.

Example 12

In this example, a plurality of marks was pad printed on the outer surface of a golf ball core having a diameter of about 1.630 inches using electrically conductive ink, according to the embodiment illustrated in FIG. 13. The plurality of marks consists of 17 equally spaced markings, including 8 markings having the shape of rectangular stripes and 9 markings having the shape of a chevron. Each of the 8 rectangular stripes has a length of about 0.48 inches and a width of about 0.08 inches. Each of the 9 markings having the shape of a chevron has a width of about 0.08 inches and each stripe is about 0.38 inches long.

The plurality of marks has a total surface coverage of about 9.5%.

The centroid of each of the marks is positioned at a vertex of one of 30 spherical triangles covering the entire surface of the core layer.

Example 13

In this example, a plurality of marks was pad printed on the outer surface of a golf ball core having a diameter of about 1.630 inches using electrically conductive ink. The plurality of marks consists of 13 equally spaced markings, each marking having the shape of a stripe. Each of the 13 stripes has a length of about 0.30 inches and a width of about 0.125 inches.

The plurality of marks has a total surface coverage of about 5.8%.

The centroid of each of the marks is positioned at a vertex of one of 22 spherical triangles covering the entire surface of the core layer.

Example 14

In this example, a plurality of marks was pad printed on the outer surface of a golf ball core having a diameter of about 1.630 inches using electrically conductive ink. The plurality of marks consists of 19 equally spaced markings, each marking having the shape of an annulus. Each of the 19 annuli has an outer diameter of about 0.30 inches and an inner diameter of about 0.15 inches. Each of the 19 annuli has a printed line thickness of about 0.075 inches.

The plurality of marks has a total surface coverage of about 12.0%.

The centroid of each of the marks is positioned at a vertex of one of 34 spherical triangles covering the entire surface of the core layer.

Example 15

In this example, a mark was pad printed on the outer surface of a golf ball cased core having a diameter of about 1.630 inches using electrically conductive ink. The mark is a continuous mark consisting of a first stripe, a second stripe, and a third stripe, according to the embodiment illustrated in FIG. 14.

The first stripe and the second stripe have substantially the same length, each of the first stripe and the second stripe having a length of about 0.90 inches. The third stripe has a length of about 0.38 inches. The first stripe, the second stripe, and the third stripe have substantially the same width, each stripe having a width of about 0.12 inches. A plane bisecting the first stripe and a plane bisecting the second stripe are separated by an angle of about 90°, as illustrated in the front view and the rear view of FIG. 14. The mark has a total surface coverage of about 2.9%.

Example 16

In this example, a mark was pad printed on the outer surface of a golf ball cased core having a diameter of about 1.630 inches using electrically conductive ink. The mark is a continuous mark consisting of a first stripe and a second stripe, according to the embodiment illustrated in FIG. 15.

The first stripe and the second stripe have substantially the same length, each of the first stripe and the second stripe having a length of about 0.90 inches. The first stripe and the second stripe have substantially the same width, each stripe having a width of about 0.12 inches. A plane bisecting the first stripe and a plane bisecting the second stripe are separated by an angle of about 90°, as illustrated in the front view and the rear view of FIG. 15. The mark has a total surface coverage of about 2.4%.

Example 17

In this example, a plurality of marks was pad printed on the outer surface of a golf ball cased core having a diameter of about 1.630 inches using electrically conductive ink. The plurality of marks consists of two non-intersecting stripes, including a first stripe and a second stripe, according to the embodiment illustrated in FIG. 16.

The first stripe and the second stripe have substantially the same length, each of the first stripe and the second stripe having a length of about 0.88 inches. The first stripe and the second stripe have substantially the same width, each stripe having a width of about 0.12 inches. A plane bisecting the first stripe and a plane bisecting the second stripe are separated by an angle of about 90°, as illustrated in the front view and the rear view of FIG. 16. The mark has a total surface coverage of about 2.5%.

Example 18

In this example, four radar detectable marks were pad printed using electrically conductive ink on the spherical outer surface of a golf ball cased core having a circumference of about 130 mm. Each of the four marks is a rectangular stripe having a length, calculated as the arc length of the longest edge, of about 7.0 mm and a width, calculated as the arc length of the shortest edge, of about 1.5 mm. The geometric center of each of the four marks is located on the same great circle on the outer surface of the cased core, allowing for a manufacturing tolerance of about 1.5 mm, and the great circle bisects each of the four marks lengthwise. The arc length on the outer surface of the cased core between the geometric centers of each pair of adjacent marks is about 16.6 mm. The smallest rectangular stripe encompassing the boundary of each of the four marks has a length of about 56.8 mm.

Example 19

In this example, eight radar detectable marks were pad printed using electrically conductive ink on the spherical outer surface of a golf ball cased core having a circumference of about 130 mm. Each of the eight marks is a rectangular stripe having a length, calculated as the arc length of the longest edge, of about 3.5 mm and a width, calculated as the arc length of the shortest edge, of about 1.5 mm. The geometric center of each of the eight marks is located on the same great circle on the outer surface of the cased core, allowing for a manufacturing tolerance of about 1.5 mm, and the great circle bisects each of the eight marks lengthwise. The arc length on the outer surface of the cased core between the geometric centers of each pair of adjacent marks is about 8.3 mm. The smallest rectangular stripe encompassing the boundary of each of the eight marks has a length of about 61.6 mm.

Example 20

In this example, ten radar detectable marks were pad printed using electronically conductive ink on the spherical outer surface 10 of a golf ball cased core having a circumference of about 130 mm, according to the embodiment illustrated in FIG. 17. Each of the ten marks 12, 13, 14, 15, 16, 22, 23, 24, 25 and 26 has the shape of a rectangular stripe.

The geometric centers of marks 12, 13, 14, 15 and 16 are located on the same great circle on the outer surface of the cased core, allowing for a manufacturing tolerance of about 1.5 mm. The geometric centers of marks 22, 23, 24, 25 and 26 are located on the same great circle on the outer surface of the cased core, allowing for a manufacturing tolerance of about 1.5 mm. Thus, marks 12, 13, 14, 15, and 16 are part of a first great circle series of marks, and marks 22, 23, 24, 25 and 26 are part of a second great circle series of marks.

Regarding the first great circle series, each of marks 12, 13, 14 and 15 has a length of about 6.6 mm, and mark 16 has a length of about 8.1 mm, length being calculated as the arc length of the longest edge of the mark. Each of marks 12, 13, 14, 15 and 16 has a width of about 1.0 mm, width being calculated as the arc length of the shortest edge of the mark. The separation distance between each pair of adjacent marks in the first great circle series is about 6.6 mm, separation distance being calculated as the spherical length of the shortest great circle arc that can be drawn on the surface of the cased core that connects any point on one mark in the pair of adjacent marks to any point on the other mark in the pair of adjacent marks. The smallest rectangular stripe encompassing the boundary of each of the marks in the first great circle series has a length of about 60.9 mm. Thus, the portion of the great circle on which the marks of the first great circle series are located has a length of about 47% of the circumference of the cased core. The angular length of the first great circle series is about 166°.

Regarding the second great circle series, each of marks 22, 23, 24 and 25 has a length of about 6.6 mm, and mark 26 has a length of about 8.1 mm, length being calculated as the arc length of the longest edge of the mark. Each of marks 22, 23, 24, 25 and 26 has a width of about 1.0 mm, width being calculated as the arc length of the shortest edge of the mark. The separation distance between each pair of adjacent marks in the second great circle series is about 6.6 mm, separation distance being calculated as the spherical length of the shortest great circle arc that can be drawn on the surface of the cased core that connects any point on one mark in the pair of adjacent marks to any point on the other mark in the pair of adjacent marks. The smallest rectangular stripe encompassing the boundary of each of the marks in the second great circle series has a length of about 60.9 mm. Thus, the portion of the great circle on which the marks of the second great circle series are located has a length of about 47% of the circumference of the cased core. The angular length of the second great circle series is about 166°.

Bisecting plane 11 is the plane that bisects the first great circle series. Bisecting plane 21 is the plane that bisects the second great circle series. Bisecting plane 11 and bisecting plane 21 are separated by an angle of about 90°, as illustrated in the front view and the rear view of FIG. 17. The total surface coverage of the ten radar detectable marks is about 1.3%.

Example 21

In this example, eleven radar detectable marks were pad printed using electronically conductive ink on the spherical outer surface 10 of a golf ball cased core having a circumference of about 130 mm, according to the embodiment illustrated in FIG. 18. Each of the eleven marks 12, 13, 14, 15, 16, 22, 23, 24, 25, 26 and 32 has the shape of a rectangular stripe.

The geometric centers of marks 12, 13, 14, 15 and 16 are located on the same great circle on the outer surface of the cased core, allowing for a manufacturing tolerance of about 1.5 mm. The geometric centers of marks 22, 23, 24, 25 and 26 are located on the same great circle on the outer surface of the cased core, allowing for a manufacturing tolerance of about 1.5 mm. Thus, marks 12, 13, 14, 15, and 16 are part of a first great circle series of marks, and marks 22, 23, 24, 25 and 26 are part of a second great circle series of marks. The geometric center of mark 32 does not lie on the same great circle as the first great circle series or the second great circle series, and, thus, is not part of a great circle series.

Regarding the first great circle series, each of marks 12, 13, 14 and 15 has a length of about 6.6 mm, and mark 16 has a length of about 8.1 mm, length being calculated as the arc length of the longest edge of the mark. Each of marks 12, 13, 14, 15 and 16 has a width of about 1.0 mm, width being calculated as the arc length of the shortest edge of the mark. The separation distance between each pair of adjacent marks in the first great circle series is about 6.6 mm, separation distance being calculated as the spherical length of the shortest great circle arc that can be drawn on the surface of the cased core that connects any point on one mark in the pair of adjacent marks to any point on the other mark in the pair of adjacent marks. The smallest rectangular stripe encompassing the boundary of each of the marks in the first great circle series has a length of about 60.9 mm. Thus, the portion of the great circle on which the marks of the first great circle series are located has a length of about 47% of the circumference of the cased core. The angular length of the first great circle series is about 166°.

Regarding the second great circle series, each of marks 22, 23, 24 and 25 has a length of about 6.6 mm, and mark 26 has a length of about 8.1 mm, length being calculated as the arc length of the longest edge of the mark. Each of marks 22, 23, 24, 25 and 26 has a width of about 1.0 mm, width being calculated as the arc length of the shortest edge of the mark. The separation distance between each pair of adjacent marks in the second great circle series is about 6.6 mm, separation distance being calculated as the spherical length of the shortest great circle arc that can be drawn on the surface of the cased core that connects any point on one mark in the pair of adjacent marks to any point on the other mark in the pair of adjacent marks. The smallest rectangular stripe encompassing the boundary of each of the marks in the second great circle series has a length of about 60.9 mm. Thus, the portion of the great circle on which the marks of the second great circle series are located has a length of about 47% of the circumference of the cased core. The angular length of the second great circle series is about 166°, according to the calculation method disclosed below.

Mark 32 has a length of about 6.6 mm and a width of about 1.0 mm, length and width being calculated as the arc length of the longest edge and shortest edge of the mark, respectively.

Bisecting plane 11 is the plane that bisects the first great circle series. Bisecting plane 21 is the plane that bisects the second great circle series. Bisecting plane 11 and bisecting plane 21 are separated by an angle of about 90°, as illustrated in the front view and the rear view of FIG. 18. The total surface coverage of the ten radar detectable marks is about 1.4%.

Example 22

FIGS. 19A-19E illustrate one example of a pattern that can be disposed or printed onto an outer surface 110 of a golf ball cased core. At least one radar detectable mark 115 is provided such that a projected pattern is formed when the at least one radar detectable mark is radially projected onto the outer surface 110 of the golf ball cased core. The projected pattern can comprise a first wave profile mapped along a path ($P_1$) defined by a first spherical arc on the outer surface 110 of the golf ball cased core. The projected pattern of FIGS. 19A-19E illustrates a sinusoidal profile or wave.

The projected pattern can comprise at least one first crest 115*a*1, 115*a*2, and at least one first trough 115*b*1, 115*b*2. In one example, there can be two crests and two troughs. In another example, there can more crests than troughs. In another example, there can be more troughs than crests. In another example, there can be more than two crests and two troughs. Terminal ends 115*c*, 115*d* of the projected pattern can be spaced apart from each other. A wave angular extent (i.e., an angular distance between the terminal ends) can be at least 45 degrees. Preferably, the wave angular extent can be 90 degrees-270 degrees. In another example, the wave angular extent can be 180 degrees-330 degrees. In one example, the wave angular extent can be 270 degrees. The wave angular extent can be defined as an angular extent measured between planes R1 and R2 as shown in FIG. 27, which is a reproduction of the rear, first side, front, and second side views of the projected pattern disclosed in FIGS. 19A-19E. Plane R1 is defined perpendicular to terminal end 115*c* and plane R2 is defined perpendicular to terminal end 115*d*.

Figure 19A:
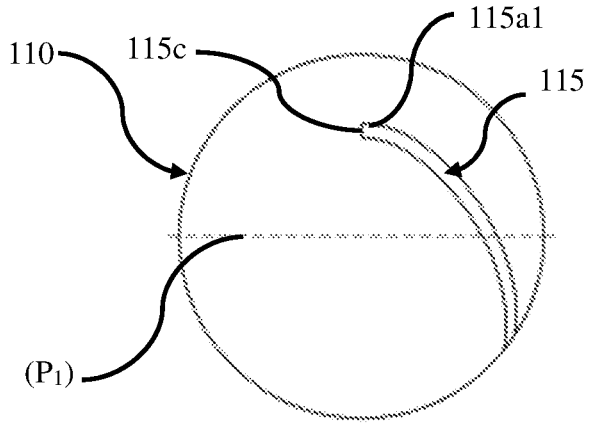
FIG. 19A illustrates a rear view of a marking pattern, according to an embodiment of the present invention.
Figure 19B:
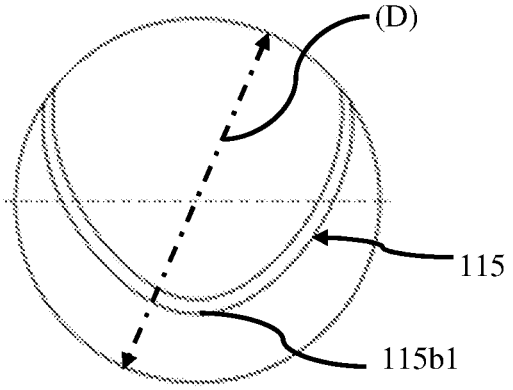
FIG. 19B illustrates a first side view of a marking pattern, according to an embodiment of the present invention.
Figure 19C:
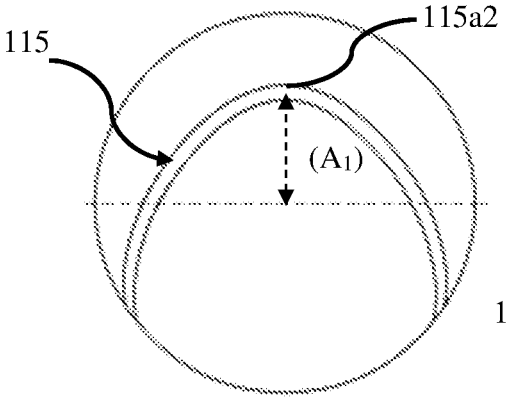
FIG. 19C illustrates a front view of a marking pattern, according to an embodiment of the present invention.
Figure 19D:
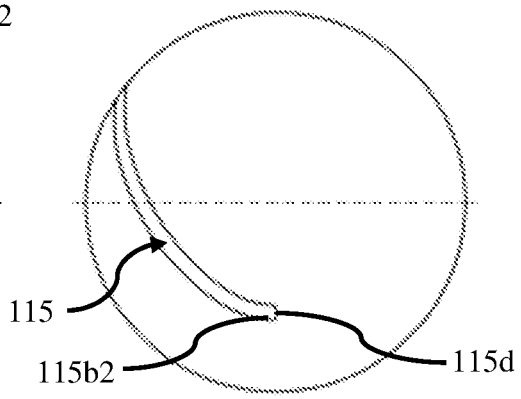
FIG. 19D illustrates a second side view of a marking pattern, according to an embodiment of the present invention.
Figure 19E:
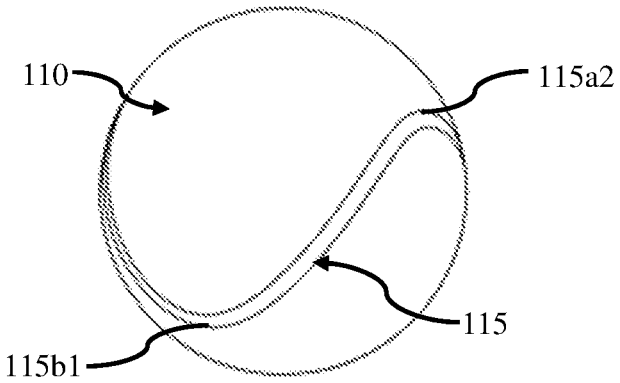
FIG. 19E illustrates an isometric view of a marking pattern, according to an embodiment of the present invention.
Figure 20A:
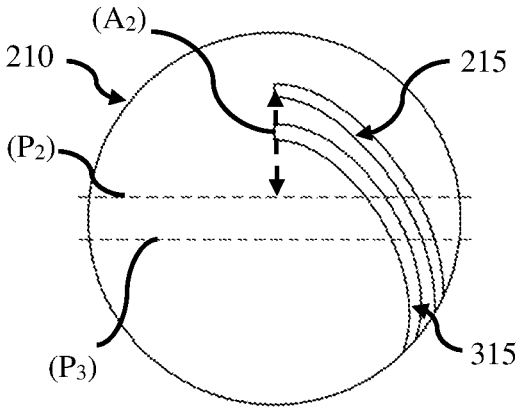
FIG. 20A illustrates a rear view of a marking pattern, according to an embodiment of the present invention.
Figure 20B:
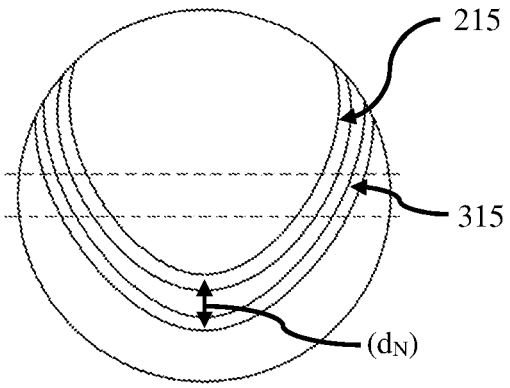
FIG. 20B illustrates a first side view of a marking pattern, according to an embodiment of the present invention.
Figure 20C:
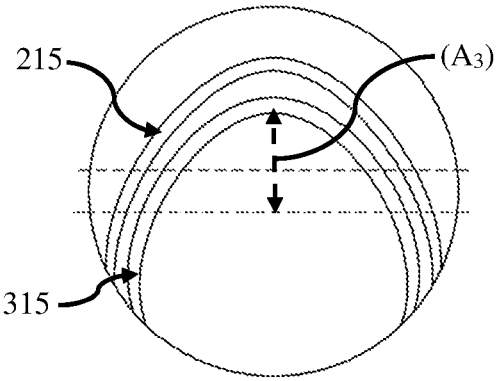
FIG. 20C illustrates a front view of a marking pattern, according to an embodiment of the present invention.
Figure 20D:
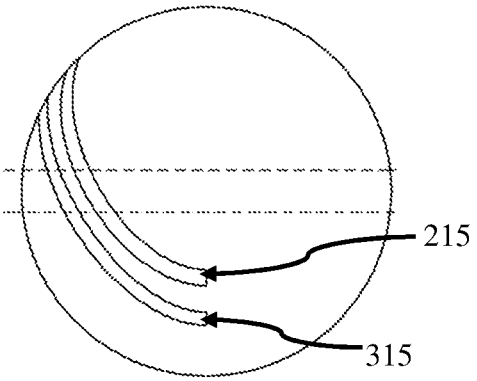
FIG. 20D illustrates a second side view of a marking pattern, according to an embodiment of the present invention.
Figure 20E:
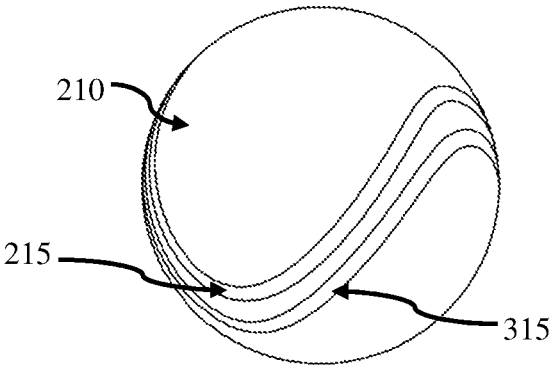
FIG. 20E illustrates an isometric view of a marking pattern, according to an embodiment of the present invention.

An amplitude ($A_1$) of the projected pattern is shown in FIG. 19C. The amplitude ($A_1$) is illustrated as a peak amplitude and shows a height or peak of the projected pattern relative to the path ($P_1$). The amplitude ($A_1$) can be 5.0 mm-20.0 mm, in one example. In one example, the amplitude ($A_1$) is at least 7.0 mm. In another example, the amplitude ($A_1$) is no greater than 15.0 mm. The diameter (D) of the golf ball cased core can have a relationship with the amplitude ($A_1$). For example, the amplitude ($A_1$) can be no greater than 40% of the diameter (D) of the golf ball cased core. In another example, the amplitude ($A_1$) can be no greater than 40% of the diameter (D) of the golf ball cased core.

A width or weight of the mark 115 can be 1.0 mm-5.0 mm, in one example. The width or weight of the mark 115 can be 2.0 mm, in one example.

As shown in FIGS. 19A-19E, the mark 115 can preferably have a total length of 4.0 inches-6.0 inches, and more preferably can have a total length of 4.77 inches. A total surface coverage of the mark 115 of FIGS. 19A-19E can preferably be 4.0%-6.0%, and more preferably can be 4.5%.

One of ordinary skill in the art would understand that the various parameters of the pattern shown in FIGS. 19A-19E can vary.

Example 23

FIGS. 20A-20E illustrate another example of a pattern that can be disposed or printed onto an outer surface 210 of a golf ball cased core. At least one first radar detectable mark 215 is provided such that a first projected pattern is formed when the at least one first radar detectable mark 215 is radially projected onto the outer surface 210 of the golf ball cased core. At least one second radar detectable mark 315 is provided such that a second projected pattern is formed when the at least one second radar detectable mark 315 is radially projected onto the outer surface 210 of the golf ball cased core. The projected patterns can comprise a first wave profile defined by the first radar detectable mark 215 that is mapped along a first path ($P_2$) defined by a first spherical arc on the outer surface 210 of the golf ball cased core, and a second wave profile defined by the second radar detectable mark 315 that is mapped along a second path ($P_3$) defined by a second spherical arc on the outer surface 210 of the golf ball cased core. The projected patterns of FIGS. 20A-20E illustrate sinusoidal profiles or waves.

The first wave profile can be comprised of a plurality of first points and the second wave profile can be comprised of a plurality of second points. Each first point along the first wave profile and each closest adjacent second point along the second wave profile can be equidistant from each other such that a uniform normal distance ($d_N$) is defined along an entirety of the first wave profile and the second wave profile. The uniform normal distance ($d_N$) can be preselected or predefined. The value of the uniform normal distance ($d_N$) can be selected based on the specific design, size, profile, etc., of the wavelets (i.e., portions of the wave profiles), as well as a diameter of the golf ball, golf ball cased core, or golf ball sub-assembly. Other parameters can be used to optimize the uniform normal distance ($d_N$). In one aspect, the uniform normal distance ($d_N$) is 4.0 mm-6.0 mm. In another aspect, the uniform normal distance ($d_N$) is 5.0 mm. In one aspect, the first path ($P_2$) is spaced apart from the second path ($P_3$) by the uniform normal distance ($d_N$). The uniform normal distance ($d_N$) can be defined from a middle portion or center of each of the first and second markings or projected patterns.

The first wave profile and the second wave profile can each have a predetermined amplitude ($A_2$, $A_3$) that is identical to each other, such that the uniform normal distance ($d_N$) is at least half of the predetermined amplitude ($A_2$, $A_3$), and the uniform normal distance ($d_N$) is no greater than twice the predetermined amplitude ($A_2$, $A_3$).

As shown in FIGS. 20A-20E, the marks 215, 315 can preferably have a total cumulative length of 8.0 inches-12.0 inches, and more preferably can have a total cumulative length of 9.47 inches. A total surface coverage of the marks 215, 315 of FIGS. 20A-20E can preferably be 7.0%-11.0%, and more preferably can be 9.0%.

Example 24

FIGS. 21A-21E illustrate one example of a pattern that can be disposed or printed onto an outer surface 410 of a golf ball cased core. At least one radar detectable mark 415 is provided such that a projected pattern is formed when the at least one radar detectable mark is radially projected onto the outer surface 410 of the golf ball cased core. The projected pattern can comprise a first wave profile mapped along a path ($P_4$) defined by a first spherical arc on the outer surface 410 of the golf ball cased core. The projected pattern of FIGS. 21A-21E illustrates a sinusoidal profile or wave.

Similar to the configuration shown in FIGS. 19A-19E, the projected pattern can comprise at least one first crest, and at least one first trough. In one example, there can be two crests and two troughs. In another example, there can more crests than troughs. In another example, there can be more troughs than crests. In another example, there can be more than two crests and troughs.

A wave angular extent of the projected pattern of FIGS. 21A-21E can be at least 45 degrees. Preferably, the wave angular extent can be 90 degrees-270 degrees. In another example, the wave angular extent can be 180 degrees-330 degrees. In another example, the wave angular extent can be 270 degrees.

Figure 21A:
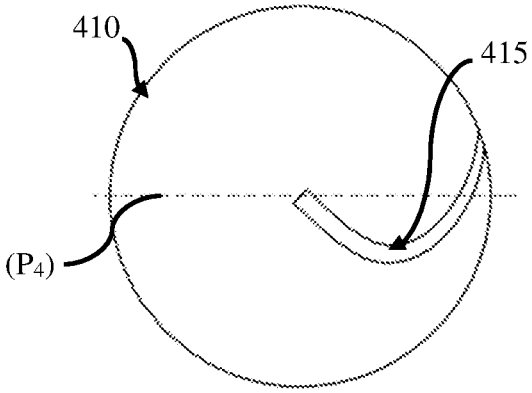
FIG. 21A illustrates a rear view of a marking pattern, according to an embodiment of the present invention.
Figure 21B:
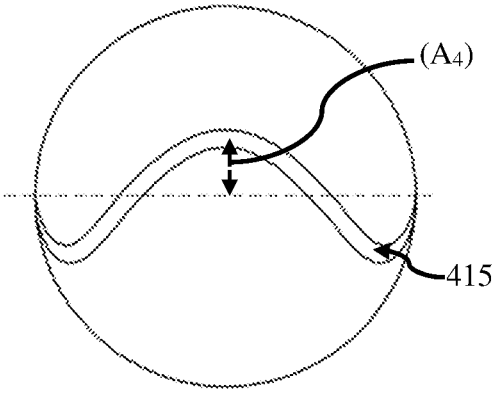
FIG. 21B illustrates a first side view of a marking pattern, according to an embodiment of the present invention.
Figure 21C:
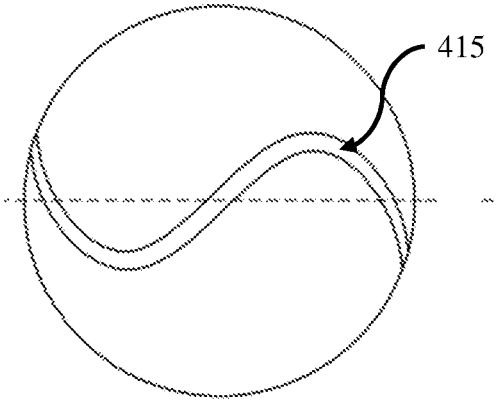
FIG. 21C illustrates a front view of a marking pattern, according to an embodiment of the present invention.
Figure 21D:
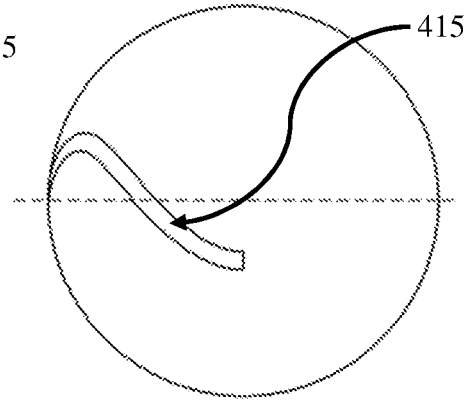
FIG. 21D illustrates a second side view of a marking pattern, according to an embodiment of the present invention.
Figure 21E:
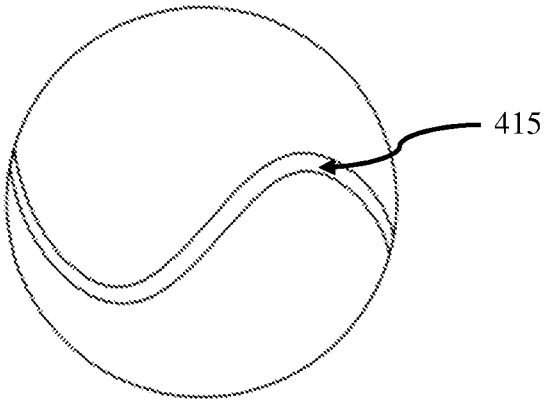
FIG. 21E illustrates an isometric view of a marking pattern, according to an embodiment of the present invention.
Figure 22A:
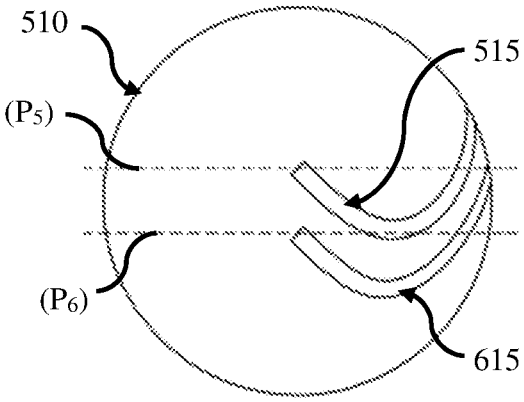
FIG. 22A illustrates a rear view of a marking pattern, according to an embodiment of the present invention.
Figure 22B:
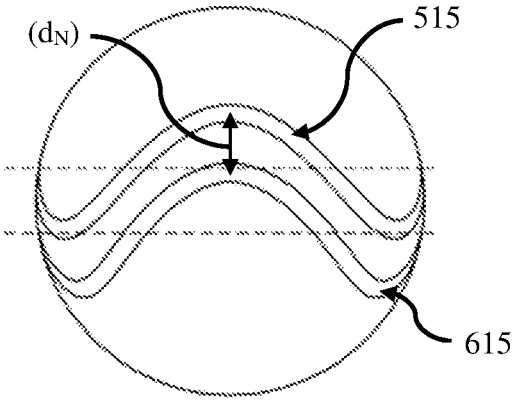
FIG. 22B illustrates a first side view of a marking pattern, according to an embodiment of the present invention.
Figure 22C:
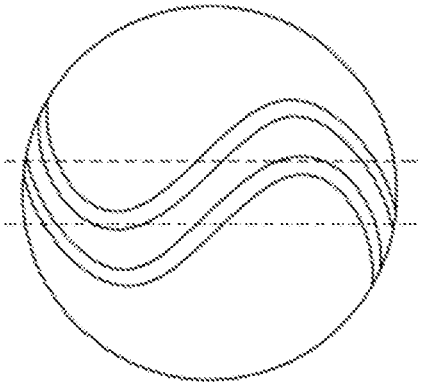
FIG. 22C illustrates a front view of a marking pattern, according to an embodiment of the present invention.
Figure 22D:
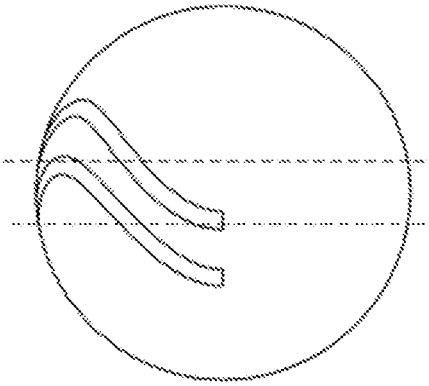
FIG. 22D illustrates a second side view of a marking pattern, according to an embodiment of the present invention.
Figure 22E:
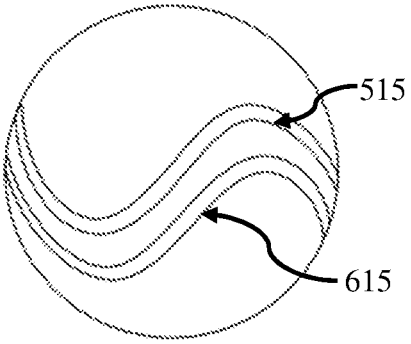
FIG. 22E illustrates an isometric view of a marking pattern, according to an embodiment of the present invention.
Figure 23A:
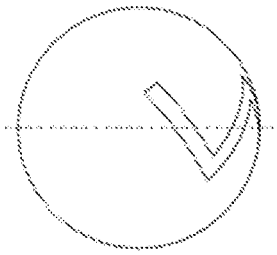
FIG. 23A illustrates a rear view of a marking pattern, according to an embodiment of the present invention.
Figure 23B:
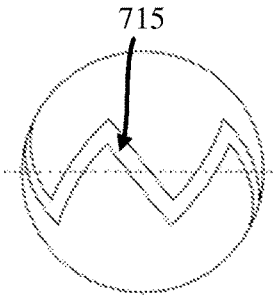
FIG. 23B illustrates a first side view of a marking pattern, according to an embodiment of the present invention.
Figure 23C:
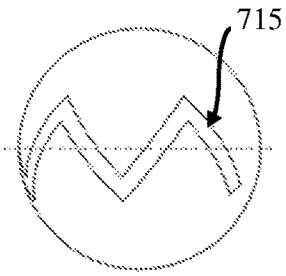
FIG. 23C illustrates a front view of a marking pattern, according to an embodiment of the present invention.
Figure 23D:
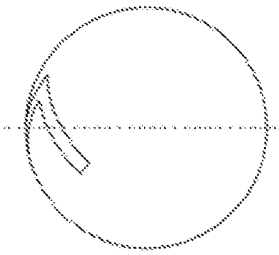
FIG. 23D illustrates a second side view of a marking pattern, according to an embodiment of the present invention.
Figure 24A:
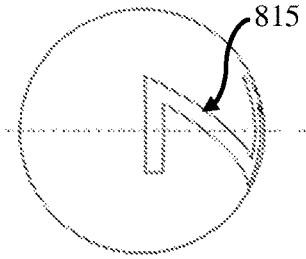
FIG. 24A illustrates a rear view of a marking pattern, according to an embodiment of the present invention.
Figure 24B:
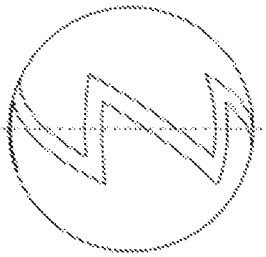
FIG. 24B illustrates a first side view of a marking pattern, according to an embodiment of the present invention.
Figure 24C:
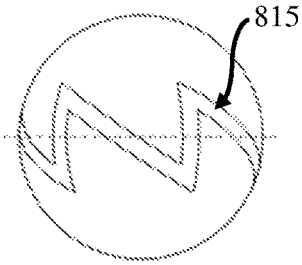
FIG. 24C illustrates a front view of a marking pattern, according to an embodiment of the present invention.
Figure 24D:
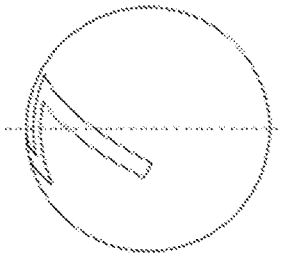
FIG. 24D illustrates a second side view of a marking pattern, according to an embodiment of the present invention.
Figure 25A:
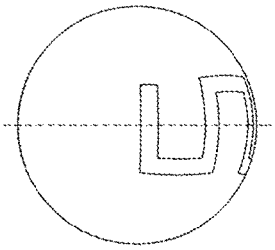
FIG. 25A illustrates a rear view of a marking pattern, according to an embodiment of the present invention.
Figure 25B:
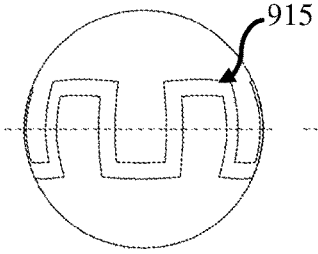
FIG. 25B illustrates a first side view of a marking pattern, according to an embodiment of the present invention.
Figure 25C:
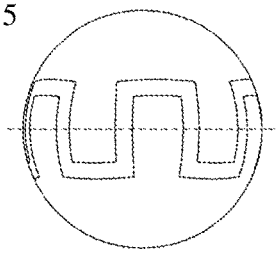
FIG. 25C illustrates a front view of a marking pattern, according to an embodiment of the present invention.
Figure 25D:
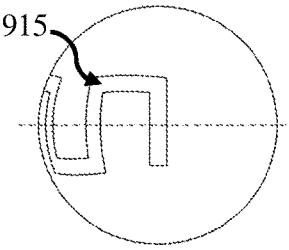
FIG. 25D illustrates a second side view of a marking pattern, according to an embodiment of the present invention.
Figure 26A:
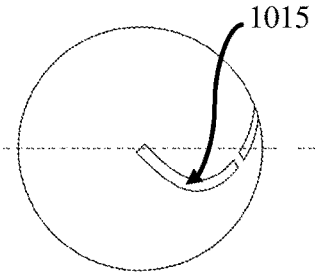
FIG. 26A illustrates a rear view of a marking pattern, according to an embodiment of the present invention.
Figure 26B:
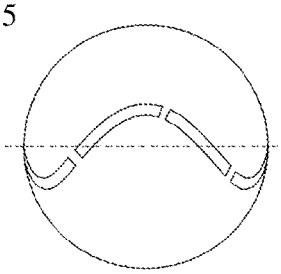
FIG. 26B illustrates a first side view of a marking pattern, according to an embodiment of the present invention.
Figure 26C:
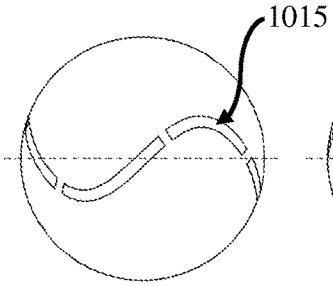
FIG. 26C illustrates a front view of a marking pattern, according to an embodiment of the present invention.
Figure 26D:
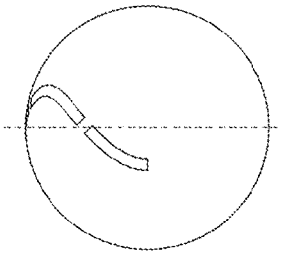
FIG. 26D illustrates a second side view of a marking pattern, according to an embodiment of the present invention.
Figure 26E:
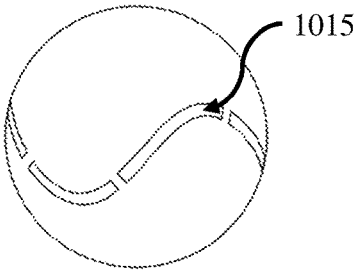
FIG. 26E illustrates an isometric view of a marking pattern, according to an embodiment of the present invention.

An amplitude ($A_4$) of the projected pattern is shown in FIG. 21B. The amplitude ($A_4$) is illustrated as a peak amplitude and shows a height or peak of the projected pattern relative to the path ($P_4$). The amplitude ($A_4$) can be 5.0 mm, in one example. The width or weight of the mark 415 can be 2.0 mm, in one example.

As shown in FIGS. 21A-21E, the mark 415 can preferably have a total length of 3.5 inches-5.5 inches, and more preferably can have a total length of 4.51 inches. A total surface coverage of the mark 415 of FIGS. 21A-21E can preferably be 3.8%-5.5%, and more preferably can be 4.3%.

Example 25

FIGS. 22A-22E illustrate another example of a pattern that can be disposed or printed onto an outer surface 510 of a golf ball cased core. The configuration illustrated in FIGS. 22A-22E is similar to the configuration illustrated in FIGS. 20A-20E.

At least one first radar detectable mark 515 is provided such that a first projected pattern is formed when the at least one first radar detectable mark 515 is radially projected onto the outer surface 510 of the golf ball cased core. At least one second radar detectable mark 615 is provided such that a second projected pattern is formed when the at least one second radar detectable mark 615 is radially projected onto the outer surface 510 of the golf ball cased core. The projected patterns can comprise a first wave profile mapped along a first path ($P_5$) defined by a first spherical arc on the outer surface 510 of the golf ball cased core, and a second wave profile mapped along a second path ($P_6$) defined by a second spherical arc on the outer surface 510 of the golf ball cased core. The projected patterns of FIGS. 22A-22E illustrate sinusoidal profiles or waves.

The first wave profile can be comprised of a plurality of first points and the second wave profile can be comprised of a plurality of second points. Each first point along the first wave profile and each closest adjacent second point along the second wave profile can be equidistant from each other such that a uniform normal distance ($d_N$) is defined along an entirety of the first wave profile and the second wave profile. The uniform normal distance ($d_N$) can be preselected or predefined. The value of the uniform normal distance ($d_N$) can be selected based on the specific design, size, profile, etc., of the wavelets (i.e., portions of the wave profiles), as well as a diameter of the golf ball, diameter of a golf ball cased core, or diameter of a golf ball sub-assembly. Other parameters can be used to optimize the uniform normal distance ($d_N$). In one aspect, the uniform normal distance ($d_N$) is 4.0 mm-6.0 mm. In another aspect, the uniform normal distance ($d_N$) is 5.0 mm. In one aspect, the first path ($P_5$) is spaced apart from the second path ($P_6$) by the uniform normal distance ($d_N$).

The first wave profile and the second wave profile can each have a predetermined amplitude that is identical to each other, such that the uniform normal distance ($d_N$) is at least half of the predetermined amplitude, and the uniform normal distance ($d_N$) is no greater than twice the predetermined amplitude.

As shown in FIGS. 22A-22E, the marks 515, 615 can preferably have a total cumulative length of 7.5 inches-11.5 inches, and more preferably can have a total cumulative length of 8.94 inches. A total surface coverage of the marks 515, 615 of FIGS. 22A-22E can preferably be 7.5%-10.5%, and more preferably can be 8.5%.

Example 26

FIGS. 23A-23D illustrate another exemplary pattern that can be disposed or printed onto an outer surface of a golf ball cased core. At least one radar detectable mark 715 is provided such that a projected pattern is formed when the at least one radar detectable mark is radially projected onto the outer surface of the golf ball cased core. The projected pattern can comprise a first wave profile mapped along a path defined by a spherical arc on the outer surface of the golf ball cased core. The projected pattern of FIGS. 23A-23D illustrates a triangular wave profile or pattern.

The amplitude, mark width or weight, wave angular extent, circumferential extent, and other properties of the mark 715 can be similar to the parameters described herein for other wave profiles or patterns.

As shown in FIGS. 23A-23D, the mark 715 can preferably have a total length of 4.25 inches-6.25 inches, and more preferably can have a total length of 5.1 inches. A total surface coverage of the mark 715 of FIGS. 23A-23D can preferably be 6.0%-8.5%, and more preferably can be 7.3%.

Example 27

FIGS. 24A-24D illustrate another exemplary pattern that can be disposed or printed onto an outer surface of a golf ball cased core. At least one radar detectable mark 815 is provided such that a projected pattern is formed when the at least one radar detectable mark is radially projected onto the outer surface of the golf ball cased core. The projected pattern can comprise a first wave profile mapped along a path defined by a spherical arc on the outer surface of the golf ball cased core. The projected pattern of FIGS. 24A-24D illustrates a sawtooth wave profile or pattern.

The amplitude, mark width or weight, wave angular extent, circumferential extent, and other properties of the mark 815 can be similar to the parameters described herein for other wave profiles or patterns.

As shown in FIGS. 24A-24D, the mark 815 can preferably have a total length of 5.5 inches-7.5 inches, and more preferably can have a total length of 6.57 inches. A total surface coverage of the mark 815 of FIGS. 24A-24D can preferably be 8.0%-10.5%, and more preferably can be 9.3%.

Example 28

FIGS. 25A-25D illustrate another exemplary pattern that can be disposed or printed onto an outer surface of a golf ball cased core. At least one radar detectable mark 915 is provided such that a projected pattern is formed when the at least one radar detectable mark is radially projected onto the outer surface of the golf ball cased core. The projected pattern can comprise a first wave profile mapped along a path defined by a spherical arc on the outer surface of the golf ball cased core. The projected pattern of FIGS. 25A-25D illustrates a square wave profile or pattern.

The amplitude, mark width or weight, wave angular extent, circumferential extent, and other properties of the mark 915 can be similar to the parameters described herein for other wave profiles or patterns.

As shown in FIGS. 25A-25D, the mark 915 can preferably have a total length of 8.0 inches-9.5 inches, and more preferably can have a total length of 8.6 inches. A total surface coverage of the mark 915 of FIGS. 25A-25D can preferably be 10.5%-14.5%, and more preferably can be 12.2%.

Example 29

FIGS. 26A-26E illustrate one example of a pattern that can be disposed or printed onto an outer surface of a golf ball cased core. At least one radar detectable mark 1015 is provided such that a projected pattern is formed when the at least one radar detectable mark is radially projected onto the outer surface of the golf ball cased core. The projected pattern can comprise a first wave profile mapped along a path defined by a first spherical arc on the outer surface of the golf ball cased core. The projected pattern of FIGS. 26A-26E illustrates a sinusoidal profile or wave.

Similar to the configuration shown in FIGS. 21A-21E, the projected pattern of FIGS. 26A-26E can comprise at least one first crest, and at least one first trough. Other aspects of the projected pattern in FIGS. 26A-26E, such as amplitude, mark width or weight, wave angular extent, circumferential extent, sinusoidal profile, etc., can be the same as the projected pattern of FIGS. 21A-21E.

The projected pattern of FIGS. 26A-26E can be formed as a plurality of discrete strips that are spaced apart from each other and aligned with each other such that the discrete strips collectively or aggregately define a wave profile. Spacing between the strips can be predetermined and can be less than a width or thickness of the marking, in one aspect. The spacing can vary depending on the desired signal detection characteristics.

As shown in FIGS. 26A-26E, the discrete strips forming the mark 1015 can preferably have a total length of 3.5 inches-5.5 inches, and more preferably can have a total length of 4.17 inches. A total surface coverage of the discrete strips forming the mark 1015 of FIGS. 26A-26E can preferably be 3.0%-5.5%, and more preferably can be 3.9%.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having at least one radar detectable mark such that a projected pattern is formed when the at least one radar detectable mark is radially projected onto an outer surface of the golf ball, the projected pattern comprising:

a first wave profile mapped along a path defined by a first spherical arc on the outer surface of the golf ball, the projected pattern comprising at least one first crest and at least one first trough, and a second wave profile comprising at least one second crest and at least one second trough, wherein the second wave profile is separate from the first wave profile such that the first and second wave profiles do not touch each other at any point, and spacing exists between an entirety of the first and second wave profiles.

2. The golf ball according to claim 1, wherein the projected pattern has a wave angular extent of at least 45 degrees.

3. The golf ball according to claim 2, wherein the wave angular extent is 240 degrees -300 degrees.

4. The golf ball according to claim 1, wherein the first spherical arc is defined along a first great circle on the outer surface of the golf ball.

5. The golf ball according to claim 1, wherein the projected pattern extends for at least 1.0 period and less than 5.0 periods.

6. The golf ball according to claim 1, wherein an amplitude of the first wave profile is less than 40% of a diameter of at least one of: the golf ball, a cased core of the golf ball, or a sub-assembly of the golf ball.

7. The golf ball according to claim 1, wherein the first wave profile is defined by a Fourier series.

8. The golf ball according to claim 1, wherein the first wave profile is defined by a periodic function.

9. The golf ball according to claim 8, wherein the first wave profile is one of: a sine wave, a sawtooth wave, a triangular wave, or a square wave.

10. The golf ball according to claim 1, wherein the projected pattern is formed as a continuous, uninterrupted strip.

11. The golf ball according to claim 1, wherein the at least one radar detectable mark has a width of 1.0 mm-5.0 mm.

12. The golf ball according to claim 1, wherein the first wave profile has an amplitude of 7.0 mm-15.0 mm.

13. A golf ball having at least one radar detectable mark such that a projected pattern is formed when the at least one radar detectable mark is radially projected onto an outer surface of the golf ball, the projected pattern comprising:

a first wave profile mapped along a path defined by a first spherical arc on the outer surface of the golf ball, the first wave profile comprising at least one first crest and at least one first trough, and a second wave profile comprising at least one second crest and at least one second trough, wherein the first wave profile is comprised of a plurality of first points and the second wave profile is comprised of a plurality of second points, and each first point along the first wave profile and each closest adjacent second point along the second wave profile are equidistant from each other such that a uniform normal distance is defined along an entirety of the first wave profile and the second wave profile.

14. The golf ball according to claim 13, wherein the uniform normal distance is 4.0 mm-6.0 mm.

15. The golf ball according to claim 13, wherein the first wave profile and the second wave profile each have a predetermined amplitude that is identical to each other, such that the uniform normal distance is at least half of the predetermined amplitude, and the uniform normal distance is no greater than twice the predetermined amplitude.

16. The golf ball according to claim 1, wherein the second wave profile is mapped along a path defined by a second spherical arc that is positioned away from the first spherical arc.

17. A golf ball having at least one radar detectable mark such that a projected pattern is formed when the at least one radar detectable mark is radially projected onto an outer surface of the golf ball, the projected pattern comprising:

a first wave profile defined by a periodic function and mapped along a path defined by a first spherical arc on the outer surface of the golf ball, wherein the periodic function is selected from: a sine wave, a sawtooth wave, a triangle wave, or a square wave, wherein the projected pattern has a wave angular extent of 45 degrees-270 degrees, and the periodic function repeats for at least 1.0 period, wherein the projected pattern further comprises:

a second wave profile with at least one second crest and at least one second trough, wherein a uniform normal distance is defined along an entirety of the first wave profile and the second wave profile, the first wave profile has a first amplitude and the second wave profile has a second amplitude, the uniform normal distance is less than half of the first amplitude, the uniform normal distance is less than half of the second amplitude, and the first amplitude is less than 40% of a diameter of at least one of: the golf ball, a cased core of the golf ball, or a sub-assembly of the golf ball.

* * * * *